US006080519A

United States Patent [19]

Ishiyama et al.

[11] Patent Number: 6,080,519

[45] Date of Patent: Jun. 27, 2000

[54] TONER FOR DEVELOPING ELECTROSTATIC CHARGE AND PROCESS FOR PRODUCING SAME, DEVELOPER AND PROCESS FOR FORMING IMAGE

[75] Inventors: Takao Ishiyama; Manabu Serizawa; Atsuhiko Eguchi; Takeshi Shoji; Yasuo Matsumura, all of Minamiashigara, Japan

[73] Assignee: Fuji Xerox Co., LTD, Tokyo, Japan

[21] Appl. No.: 09/377,180

[22] Filed: Aug. 19, 1999

[30] Foreign Application Priority Data

Sep. 3, 1998 [JP] Japan ..... 10-249852

[51] Int. Cl.[7] ..... G03G 9/087

[52] U.S. Cl. ..... 430/109; 430/110

[58] Field of Search ..... 430/109, 110

[56] References Cited

U.S. PATENT DOCUMENTS

| | | | |
|---|---|---|---|
| 5,744,276 | 4/1998 | Ohno et al. | 430/109 |
| 5,753,400 | 5/1998 | Kuramoto et al. | 430/109 |
| 6,002,903 | 12/1999 | Hayase et al. | 430/109 |

FOREIGN PATENT DOCUMENTS

| | | |
|---|---|---|
| 63-282752 | 11/1988 | Japan . |
| 2-105163 | 4/1990 | Japan . |
| 4-188156 | 7/1992 | Japan . |
| 4-308878 | 10/1992 | Japan . |
| 5-61239 | 3/1993 | Japan . |
| 6-250439 | 9/1994 | Japan . |
| 8-101531 | 4/1996 | Japan . |

*Primary Examiner*—John Goodrow
*Attorney, Agent, or Firm*—Oliff & Berridge, PLC

[57] ABSTRACT

It is to provide a toner for developing static charge and a process for producing the same that is excellent in peelability of the fixing sheet, adhesion of the fixed image, bending resistance of the fixed image, Dispersibility of the releasing agent in the toner and transparency on an OHP sheet, and can provide a high quality fixed image, as well as a developer and a process for forming an image. It relates to a toner for developing electrostatic charge of the invention including a coloring agent and a binder resin and a process for producing the same, wherein the relaxation modulus of elasticity G(t) at a relaxation time t=10×Dt (wherein Dt represents a heating time on fixing) obtained from measurement of dynamic viscoelasticity is adjusted to a range of from $2.0\times10^2$ to $3.0\times10^3$ Pa, or the relaxation modulus of elasticity G(t=0.01) at a relaxation time of 0.01 sec obtained from measurement of dynamic viscoelasticity is adjusted to a range of from $2.0\times10^2$ to $3.0\times10^4$ Pa, and the ratio G(r) (G(t=0.01)/G(t=0.1)) of the relaxation modulus of elasticity G(t=0.01) to a relaxation modulus of elasticity G(t=0.1) at a relaxation time of 0.1 sec is adjusted to a range of from 1.0 to 18.0, as well as a developer and a process for forming an image using the developer.

18 Claims, 1 Drawing Sheet

TONER FOR DEVELOPING ELECTROSTATIC CHARGE AND PROCESS FOR PRODUCING SAME, DEVELOPER AND PROCESS FOR FORMING IMAGE

FIELD OF THE INVENTION

The present invention relates to a toner used for developing, by using a developer, an electrostatic latent image formed by an electrophotography method or an electrostatic recording method, a process for producing the toner, a developer and a process for forming an image.

BACKGROUND OF THE INVENTION

In an electrophotography method, an electrostatic image is formed on a photosensitive body by an exposure step, and the electrostatic latent image is visualized by developing with a developer containing a toner, followed by subjecting a transfer step and a fixing step.

The toner is generally produced by a kneading and pulverization method. Inorganic or organic fine particles are added to the surface of the toner produced by this method depending on necessity, and a toner exhibiting excellent performance can be produced by this method. However, it involves the following problems.

In the general kneading and pulverization method, a toner may form fine powder or may suffer change in its shape due to a mechanical shearing force applied to the toner in a developing apparatus. It brings about problems in that the fine powder sticks on a surface of a carrier to accelerate charge deterioration of the developer, the particle size distribution is broadened to cause scattering of the toner, and the development property is deteriorated by the change of the shape of the toner to cause deterioration of the image quality.

In the case where a releasing agent such as a wax is internally added to a toner produced by the pulverization method, the wax present on the surface of the toner is easily transferred to surfaces of a development roll, a photosensitive body and a carrier by a mechanical force to contaminate them, and thus the reliability is lowered.

Furthermore, because the shape of the toner is irregular, the fluidability of the toner is deteriorated with the lapse of time, and a fluidizing agent is buried in the interior of the toner to deteriorate the developing property, the transferring property and the cleaning property. When the toner recovered in the cleaning step is reused in the developing apparatus, the image quality is further deteriorated. In the case where the amount of the fluidizing agent is increased to prevent these problems, another problem occurs in that black spots are formed on the surface of the photosensitive body, or the particles of the fluidizing agent is scattered.

In recent years, as a method for positively controlling the shape and the surface structure of the toner, a process for producing a toner by an emulsion polymerization aggregation method has been proposed in JP-A-63-282752 and JP-A-6-250439. However, it still involves problems in stabilization of the peelability of a fixing sheet on fixing and the transparency on printing on an OHP sheet.

In a recent digital full-color duplicating machine and printer, the demand of which is being increased, development is conducted by utilizing subtractive color mixing using developers of Y (yellow), M (magenta), C (cyan) and Bk (black), and therefore an image is formed by using a larger amount of the developer than the machine for forming a monochrome image. Furthermore, in addition to a text image, which has been conventionally, printed, duplication or printing of a solid image, such as a photograph or a picture, is frequently conducted in such an apparatus. In view of such circumstances, high reliability on fixing in a low temperature range is demanded.

In order to satisfy the demand, it is required to obtain an image of good quality by certainly adhering a toner image to paper by high-speed fixing, i.e., application of heat and pressure in a short period of time, without forming offset in a fixing roll and also without causing damage in the image due to stress after fixing.

As a measure for satisfying the demand, for example, JP-A-8-101531 proposes a toner, in which an extremely low molecular weight component is excluded from the binder resin, but unevenness of gloss and damages due to bending are liable to occur.

With respect to the peelability of an image from a fixing roll, i.e., so-called releasability, a method is frequently employed in that a releasing agent is uniformly coated on the surface of the fixing roll particularly in a color-duplicating machine (JP-A-4-308878). However, there are problems in that the effect of the releasing agent is largely lowered due to deterioration of the releasing substance with the lapse of time, the cost is increased due to the fixing device becoming large and complex, and the releasing substance is transferred to the surface of the receiving material so that writing with a ballpoint pen on the receiving material becomes impossible, and an adhesive tape cannot be attached to the receiving material.

In order to avoid the problems, JP-A-5-61239 proposes a toner for oil-less fixing containing a large amount of releasing substance, but the releasability cannot be stable. The Dispersibility of the materials within the toner largely influences not only on the adhesion of the fixed image on paper, the releasability of the fixed image from the fixing roll, and the bending resistance and the gloss after fixing, but also on the total fixing performance such as the transparency on an OHP sheet.

As a method for improving the Dispersibility of the releasing agent, JP-A-2-105163, for example, proposes to introduce a resin having a polar group to improve the encompassment and oozing of the releasing agent, but it cannot sufficiently improve the fixing property.

As another method for improving the dispersibility of the releasing agent, JP-A-4-188156 proposes to previously treat the surface of a coloring agent, but it involves the problems described above, and also the stable transparency on an OHP sheet is difficult to be obtained.

As described in the foregoing, the behavior in molten state and the control of structure formation of the toner and the constitutional components thereof are important for the adhesion to paper and the peelability from the fixing roll of a toner image, and the Dispersibility of the releasing agent and the coloring agent. The quantitative determination of those properties is generally achieved by using, as the standard, the relaxation modulus of elasticity and the relaxation time obtained from the measurement of dynamic viscoelasticity.

In general, in the case where a distortion is applied to an article to be measured, such as a toner, the stress thus generated exhibits exponential decay behavior, in which the stress S after the lapse of time $t_1$ is expressed by $S=S_0.e^{-1/t}$, where $S_0$ is the initial stress, and the time where $t_1$ agrees to t is determined as the relaxation time. The relaxation modulus of elasticity is a value obtained by dividing the stress S by the deformation amount.

The stress-relaxation behavior is greatly influenced by the viscoelasticity of the binder resin and the structure, the size and the amount of the releasing agent dispersed in the resin, and the molten state thereof can be expressed by the relaxation behavior, i.e., the relaxation modulus of elasticity and the relaxation time. However, there has been no example of positively applying them to the molten behavior and the viscoelasticity control on fixing of the toner.

SUMMARY OF THE INVENTION

An object of the invention is to solve the problems described above and to provide a toner for developing electrostatic charge and a process for producing the same, a developer and a process for forming an image, by which a high quality fixed image excellent in peelability of a fixing sheet, adhesion of the fixed image, bending resistance of the fixed image, dispersibility of a releasing agent in the toner and transparency on an OHP sheet can be provided.

As a result of earnest investigation made by the inventors to solve the problems described above, the problems can be solved by the following constitutions.

(1) A toner for developing electrostatic charge comprising a coloring agent and a binder resin, the toner having a relaxation modulus of elasticity G(t) at a relaxation time t=10×Dt (wherein Dt represents a heating time on fixing) obtained from measurement of dynamic viscoelasticity in a range of from $2.0\times10^2$ to $3.0\times10^3$ Pa.

(2) A toner for developing electrostatic charge comprising a coloring agent and a binder resin, the toner having a relaxation modulus of elasticity G(t=0.01) at a relaxation time of 0.01 sec obtained from measurement of dynamic viscoelasticity in a range of from $2.0\times10^2$ to $3.0\times10^4$ Pa, and a ratio G(r) (G(t=0.01)/G(t=0.1)) of the relaxation modulus of elasticity G(t=0.01) to a relaxation modulus of elasticity G(t=0.1) at a relaxation time of 0.1 sec in a range of from 1.0 to 18.0.

(3) A toner for developing electrostatic charge as in item (1) or (2) above, wherein the toner for developing electrostatic charge further comprises a releasing agent.

(4) A toner for developing electrostatic charge as in one of items (1) to (3) above, wherein the toner for developing electrostatic charge has an acid value of from 10 to 50 mg-KOH.

(5) A toner for developing electrostatic charge as in one of items (1) to (4) above, wherein the releasing agent has a main maximum peak measured according to ASTEM D3418-8 in a range of from 50 to 140° C.

(6) A toner for developing electrostatic charge as in one of items (1) to (5) above, wherein the toner for developing electrostatic charge further comprises a releasing agent having an average particle diameter measured by a transmission electron microscope (TEM) in a range of from 150 to 1,500 nm.

(7) A toner for developing electrostatic charge as in item (5) or (6) above, wherein the toner for developing electrostatic charge further comprises the releasing agent in an amount of from 5 to 25 parts by weight of toner.

(8) A toner for developing electrostatic charge as in one of items (1) to (7) above, wherein the coloring agent has an average particle diameter measured by a transmission electron microscope (TEM) in a range of from 100 to 330 nm.

(9) A toner for developing electrostatic charge as in item (8) above, wherein a content of the coloring agent is from 4 to 15% by weight.

(10) A toner for developing electrostatic charge as in one of items (1) to (9) above, wherein the toner for developing electrostatic charge has a volume average particle diameter $D_{50v}$ in a range of from 2 to 9 μm, a volume average particle diameter distribution coefficient GSDv ($D_{84v}/D_{16v}$) of 1.30 or less, and a ratio (GSDv/GSDp) of the volume average particle diameter distribution coefficient GSDv to a number average particle diameter distribution coefficient GSDp ($D_{84p}/D_{16p}$) of 0.95 or more.

(11) A toner for developing electrostatic charge as in one of items (1) to (10) above, wherein the toner for developing electrostatic charge has a shape factor SF1 (an average value of (circumference length squared/projected area)) in a range of from 110 to 140.

(12) A toner for developing electrostatic charge as in one of items (1) to (11) above, wherein the toner for developing electrostatic charge has an absolute value of a charge amount in a range of from 20 to 40 μC/g.

(13) A process for producing a toner for developing electrostatic charge as in one of items (1) to (12) above, the process comprising the steps of: mixing a resin fine particle dispersion having resin fine particles having a diameter of 1 μm or less dispersed therein and a coloring agent particle dispersion to form an aggregated particle dispersion of the resin fine particles, the coloring agent particles and releasing agent particles; and then heating to a temperature higher than a glass transition point of the resin fine particles to fuse and unite the particles.

(14) A process for producing a toner for developing electrostatic charge as in item (13) above, wherein the process comprises the steps of: after forming the aggregated particle dispersion, adding and mixing a releasing agent particle dispersion and/or a resin fine particle dispersion having resin fine particles for surface modification dispersed therein, to attach the particles on a surface of the aggregated particles; and then heating to a temperature higher than a glass transition points of the resin fine particles contained in the aggregated particles and the resin fine particles for surface modification to fuse and unite the particles.

(15) A process for producing a toner for developing electrostatic charge as in item (13) or (14) above, wherein a polymer of at least one metallic salt is added on forming the aggregated particle dispersion.

(16) A process for producing a toner for developing electrostatic charge as in item (15) above, wherein the polymer of a metallic salt is a polymer of at least one inorganic salt of aluminum.

(17) A process for producing a toner for developing electrostatic charge as in one of items (13) to (16) above, wherein the coloring agent particles are covered with a polar resin particles having an acid value of from 10 to 50 mg-KOH.

(18) A process for producing a toner for developing electrostatic charge as in item (17) above, 100 parts by weight of the coloring agent particles are covered with from 0.47 to 5.0 parts by weight of the polar resin particles.

(19) A developer for developing electrostatic charge comprising a carrier and a toner, the toner is a toner for developing electrostatic charge as in one of items (1) to (12) above.

(20) A developer for developing electrostatic charge as in item (19) above, wherein the carrier has a resin coating layer.

(21) A process for forming an image comprising a step of forming an electrostatic latent image on an electrostatic image supporting material; a step of forming a toner image by developing the electrostatic latent image with a developer on a developer supporting material; and a step of transferring the toner image to a receiving material, wherein the developer is a developer for developing electrostatic charge as in item (19) or (20) above.

(22) A process for forming an image as in item (21) above, wherein the toner image is fixed by an oil-less fixing method.

(23) A process for forming an image as in item (21) or (22) above, wherein the toner image on the receiving material is fixed by a fixing roll having a surface layer comprising a fluorine resin.

(24) A process for forming an image as in one of items (21) to (23) above, wherein the process further comprises a step of recovering a toner for developing electrostatic charge remaining unused for forming the toner image; and a step of recycling the toner for developing electrostatic charge recovered in the recovering step into a developing apparatus.

DETAILED DESCRIPTION OF THE INVENTION

Figure 1:
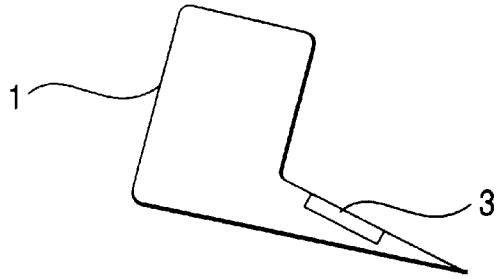
FIG. 1 is a cross sectional view of a peeling tooth used in the measurement of peeling strength in the invention.

In the toner for developing electrostatic charge of the invention, the relaxation modulus of elasticity G(t) at a relaxation time t=10×Dt (wherein Dt represents a heating time on fixing) obtained from measurement of dynamic viscoelasticity is adjusted to a range of from $2.0\times10^2$ to $3.0\times10^3$ Pa; or the relaxation modulus of elasticity G(t=0.01) at a relaxation time of 0.01 sec obtained from measurement of dynamic viscoelasticity is adjusted to a range of from $2.0\times10^2$ to $3.0\times10^4$ Pa, and the ratio G(r) (G(t=0.01)/G(t=0.1)) of the relaxation modulus of elasticity G(t=0.01) to a relaxation modulus of elasticity G(t=0.1) at a relaxation time of 0.1 sec is adjusted to a range of from 1.0 to 18.0, so as to complete a toner for developing electrostatic charge that can provide durability of a high quality fixed image excellent in peelability of a fixing sheet, adhesion of the fixed image, bending resistance of the fixed image, Dispersibility of the releasing agent contained in the toner, and transparency on an OHP sheet.

In the toner for developing electrostatic charge containing a coloring agent and a binder resin of the invention, it is suitable that the relaxation modulus of elasticity G(t) at a relaxation time t=10×Dt (wherein Dt represents a heating time on fixing) obtained from measurement of dynamic viscoelasticity is adjusted to a range of from $2.0\times10^2$ to $3.0\times10^3$ Pa, and preferably to a range of from $2.3\times10^2$ to $2.8\times10^3$ Pa. When the relaxation modulus of elasticity G(t) at the relaxation time is less than $2.0\times10^2$ Pa, the sufficient aggregation force among the toner cannot be obtained, which become a cause of an offset phenomenon and peeling failure particularly at a low temperature side. Furthermore, in the fixed image, a defect of the image due to a stress such as bending is liable to occur. On the other hand, when the relaxation modulus of elasticity G(t) at the relaxation time is exceeds $3.0\times10^3$ Pa, the penetration property and the adhesion property to the receiving sheet are deteriorated, and thus the sufficient fixing strength cannot be obtained. Furthermore, because the viscosity of the toner on melting is increased, it becomes a cause of deterioration of the image quality, such as decrease in surface gloss and image unevenness.

In the invention, it is suitable that the relaxation modulus of elasticity G(t=0.01) at a relaxation time of 0.01 sec obtained from measurement of dynamic viscoelasticity is adjusted to a range of from $2.0\times10^2$ to $3.0\times10^4$ Pa, and the ratio G(r) (G(t=0.01)/G(t=0.1)) of the relaxation modulus of elasticity G(t=0.01) to a relaxation modulus of elasticity G(t=0.1) at a relaxation time of 0.1 sec is adjusted to a range of from 1.0 to 18.0. When the relaxation modulus of elasticity G(t=0.01) is less than $2.0\times10^2$ Pa, problems of offset and surface roughening of the fixed image occur, and when it exceeds $3.0\times10^4$ Pa, a problem of difficulty in obtaining gloss of the fixed image occurs. When the ratio G(r) (G(t=0.01)/G(t=0.1)) of the relaxation modulus of elasticity is less than 1.0, a problem of forming gloss unevenness of the fixed image, and when it exceeds 18.0, a problem of not obtaining fixing latitude. The preferred range of the relaxation modulus of elasticity G(t=0.01) is from $2.3\times10^2$ to $2.8\times10^4$ Pa, and the preferred range of the ratio G(r) (G(t=0.01)/G(t=0.1) ) of the relaxation modulus of elasticity is from 1.0 to 17.0.

The relaxation modulus of elasticity and the relaxation time in the invention are obtained from the dynamic viscoelasticity measured by a frequency dispersion measurement method by a sin wave vibration method. For the measurement of the dynamic viscoelasticity, ARES measurement apparatus produced by Rheometric Scientific, Inc.

On the measurement of the dynamic viscoelasticity, the toner formed into a tablet form is set on a parallel plate having a diameter of 25 mm, and after the normal force is made 0, a sin wave vibration at a vibration frequency of from 0.1 to 110 rad/sec is applied. The measurement is started from 100° C. and continued to 160° C. The interval of measurement time is 30 seconds, and the accuracy of temperature control after starting the measurement is ±1.0° C. The distortion amount at the respective measurement temperatures is suitably maintained during the measurement, and it is appropriately adjusted to obtain proper measurement values. The relaxation modulus of elasticity and the relaxation time are obtained from the measurement results obtained at the respective measurement temperatures.

The acid value of the toner of the invention is not only to increase and stabilize the encompassment of the releasing agent particles and the coloring agent particles in the toner, but also important for the charge property, and is suitably in a range of from 10 to 50 mg-KOH. When the acid value is less than 10 mg-KOH, the encompassment and the stability of the releasing agent particles and the coloring agent particles are liable to be decreased, and the charge property is also liable to be decreased. When it exceeds 50 mg-KOH, a component endowing the acid value is liable to be crosslinked, and the fixing property is liable to be deteriorated.

With respect to the releasing agent used in the invention, it is dispersed in the toner for developing electrostatic charge in the form of particles having an average particle diameter of from 150 to 1,500 nm in an amount of from 5 to 25% by weight, so as to improve the peelability of the fixed image on an oil-less fixing method. The preferred range of the average particle diameter is from 160 to 1,400 nm, and that of the content is from 7 to 23% by weight of toner. The preferred order of coating of the releasing agent particles in the invention is that after forming the aggregated particles, the releasing agent particles are coated, and the resin fine particles for surface modification are coated.

The coloring agent used in the invention is dispersed in the toner for developing electrostatic charge in the form of particles having an average particle diameter of from 100 to 330 nm in an amount of from 4 to 15% by weight of toner, so as to improve not only the coloring property but also the transparency on an OHP sheet. The preferred average particle diameter is from 120 to 310 nm, and the preferred content is from 5 to 14% by weight of toner.

In the invention, a toner for developing electrostatic charge that can provide an image excellent in image minuteness is provided by making the volume average particle diameter $D_{50v}$ to a range of from 2 to 9 μm, the volume average particle diameter distribution coefficient GSDv ($D_{84v}/D_{16v}$) to 1.30 or less, and the ratio (GSDv/GSDp) of the volume average particle diameter distribution coefficient GSDv to a number average particle diameter distribution coefficient GSDp of 0.95 or more. The preferred range of $D_{50v}$ is from 3 to 8 μm, that of GSDv is from 1.0 to 1.28, and that of the ratio of GSDv/GSDp is from 0.95 to 1.2.

When the volume average particle diameter $D_{50v}$ of the toner is less than 2 μm, the charge property of the toner becomes insufficient to lower the developing property. When it exceeds 9 μm, the resolution property of the image is lowered. When the volume average particle diameter distribution coefficient GSDv exceeds 1.30, the resolution property is lowered, and when the ratio (GSDv/GSDp) of the volume average particle diameter distribution coefficient to a number average particle diameter distribution coefficient is less than 0.95, the charge property is lowered, which becomes a cause of scattering of the toner and fogging.

The volume average particle diameter, the volume average particle diameter distribution coefficient and the number average particle diameter distribution coefficient in the invention can be measured, for example, with a measuring apparatus, such as Coulter Counter TA-II (produced by Nikkaki Co., Ltd.) and Multisizer II (produced by Nikkaki Co., Ltd.). The particle diameter distribution is obtained by the following manner. An accumulated distribution of the divided particle diameter range (channel) is produced for each of volume and number from the side of the small diameter, and the particle diameter at which the accumulated value becomes 16% is determined as the volume average particle diameter $D_{16v}$ and the number average particle diameter $D_{16p}$, and the particle diameter at which the accumulated value becomes 84% is determined as the volume average particle diameter $D_{84v}$ and the number average particle diameter $D_{84p}$. The volume average particle diameter distribution coefficient GSDv is obtained from $\sqrt{D_{84v}/D_{16v}}$, and the number average particle diameter distribution coefficient GSDp is obtained from $D_{84p}/D_{16p}$.

In the invention, a toner for developing electrostatic charge excellent in developing property and transfer property by making the shape factor SF1 in a range of from 110 to 140. The preferred range of SF1 is from 110 to 138. The shape factor SF1 is an average value of the shape factor (circumference length squared/projected area), which is calculated by the following manner. An optical micrograph of a toner scattered on a slide glass is imported to a LUZEX image analyzing device through a video camera, to calculate (circumference length squared/projected area) ($ML^2/A$) values of 50 or more of the toner particles, and then an average value thereof is obtained.

The absolute value of the charge amount of the toner for developing electrostatic charge of the invention is suitably in a range of from 20 to 40 μC/g, and preferably from 20 to 35 μC/g. When the charge amount is less than 20 μC/g, background contamination (fogging) is liable to occur, and when it exceeds 40 μC/g, the image density is liable to be lowered. The ratio of the charge amount of the toner for developing electrostatic charge in the summertime (high temperature and high humidity) to that in the wintertime (low temperature and low humidity) is suitably in a range of from 0.5 to 1.5, and preferably in a range of from 0.7 to 1.3. When the ratio is outside the range, it is not practically preferred since the environment dependency of the charge property is large, and the stability of charge is lacked.

A process for producing the toner for developing electrostatic charge according to the invention will be described in detail below.

While not particularly limited, the resin fine particles used in the invention is generally produced by preparing a resin fine particle dispersion containing a first ionic surface active agent by an emulsion polymerization method; mixing with a coloring agent particle dispersion and a releasing agent particle dispersion; forming hetero-aggregation with a second ionic surface active agent having a polarity contrary to that of the first ionic surface active agent, to form aggregated particles having a toner diameter; and heating to a temperature higher than the glass transition point of the resin fine particles to fuse and unite the aggregated particles, so that the toner is obtained through washing and drying. With respect to the shape of the toner, those having a spherical shape to an irregular shape are preferably used.

In the initial stage of mixing the resin fine particle dispersion, the coloring agent particle dispersion and the releasing agent particle dispersion in the aggregation step described above, it is possible employ the following two-step method. While the ionic balance of the ionic dispersants of different polarities has been deviated, it is ironically neutralized by adding a polymer of an inorganic metallic salt such as polyaluminum chloride, and then mother aggregated particles of the first step is formed at a temperature lower than the glass transition point. After the dispersion is stabilized, as the second step, a resin fine particle dispersion treated with an ionic dispersant of a polarity and an amount that compensates the deviation of the ionic balance is added. The dispersion is slightly heated, depending on necessity, at a temperature lower than the glass transition point of the resin contained in the resin fine particles and the additional resin fine particles in the aggregated particles, to stabilize at a higher temperature. Thereafter, the dispersion is heated to a temperature higher than the glass transition point to unite the mother aggregated particles having the particles added in the second step attached to the surface thereof. The two-step aggregation method may be further repeated in plural times. The two-step method is effective to improve the encompassment of the releasing agent and the coloring agent.

The polymer used as the resin fine particles of the invention is not particularly limited, and examples thereof include a homopolymer of a monomer including a styrene series compound, such as styrene, p-chlorostyrene and α-methylstyrene; an ester series compound containing a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; a vinyl nitrile series compound, such as acrylonitrile and methacrylonitrile; a vinyl ether series compound, such as vinyl methyl ether and vinyl isobutyl ether; a vinyl ketone series compound, such as vinyl methyl ketone, vinyl ethyl ketone and vinyl isopropenyl ketone; and an olefin series compound, such as ethylene, propylene and butadiene, a copolymer obtained from a combination of two or more of them, and a mixture thereof. Further examples thereof include an epoxy resin, a polyester resin, a polyurethane resin, a polyamide resin, a cellulose resin, a polyether resin, a non-vinyl condensation resin, a mixture of these resin with the vinyl series resin described above, and a graft polymer obtained by polymerizing the vinyl monomer in the presence of those polymers.

In the case where the vinyl monomer is used, the resin fine particle dispersion can be produced by conducting emulsion polymerization using an ionic surface-active agent. In the case of the other resins, where the resin is lipophilic and soluble in a solvent having a relatively low solubility in water, the resin is dissolved in the solvent and dispersed in water by a dispersing device such as a homogenizer along with a surface active agent and a polymeric electrolyte, and the solvent is then evaporated by heating or reducing the pressure to produce the resin fine particle dispersion.

The particle diameter of the resin fine particles in the dispersion is measured by a laser defecation particle size distribution measurement apparatus LA-700 (produced by Horiba, Ltd.).

As the releasing agent used in the present invention, a substance having a main maximum peak measured according to ASTEM D3418-8 in a range of from 50 to 140° C., preferably in a range of from 60 to 120° C., is preferred. When it is less than 50° C., offset is liable to occur on fixing. When it exceeds 140° C., the fixing temperature becomes high, and smoothness of the surface of the fixed image cannot be obtained to deteriorate the gloss property.

The measurement of the main maximum peak is conducted by using DSC-7 produced by Perkin-Elmer, Ltd. The temperature compensation of the detector part of the apparatus is conducted by utilizing the melting points of indium and zinc, and the compensation of quantity of heat is conducted by utilizing the heat of melting of indium. A sample is measured on an aluminum pan with a blank pan used as the control at a temperature increasing rate of 10° C. per minute.

Examples of specific substances used as the releasing agent include a low molecular weight polyolefin, such as polyethylene, polypropylene and polybutene; a silicone having a softening point by heating; an aliphatic amide, such as oleic amide, erucic amide, ricinolic amide and stearic amide; a vegetable wax, such as carnauba wax, rice wax, candelilla wax, haze wax and jojoba oil; an animal wax, such as bees wax; a mineral or petroleum wax, such as montan wax, ozocerite, ceresine, paraffin wax, microcrystalline wax and Fischer-Tropsch wax; and a modification product thereof.

The wax is dispersed in water along with an ionic surface active agent or a polymeric electrolyte, such as a polymeric acid and a polymeric base, and made into fine particles by applying a strong shearing force by a homogenizer or a pressure-discharge disperser with heating to a temperature higher than the melting point, so as to produce a dispersion of releasing agent particles having a diameter of 1 $\mu$m or less.

The particle diameter of the releasing agent particles in the dispersion are measured by a laser defecation particle size distribution measurement apparatus LA-700 (produced by Horiba, Ltd.).

As the coloring agent used in the invention, known coloring agent can be used. Examples of a black pigment include carbon black, copper oxide, manganese dioxide, aniline black, activated carbon, non-magnetic ferrite and magnetite.

Examples of a yellow pigment include chrome yellow, zinc yellow, yellow iron oxide, cadmium yellow, Chrome Yellow, Hansa Yellow, Hansa Yellow 10G, Benzidine Yellow G, Benzidine Yellow GR, Styrene Yellow, Quinoline Yellow and Permanent Yellow NCG.

Examples of an orange pigment include red chrome yellow, molybdenum orange, Permanent Orange GTR, Pyrazolone Orange, Vulcan Orange, Benzidine Orange G, Indanthrene Brilliant Orange RK and Indanthrene Brilliant Orange GK.

Examples of a red pigment include red iron oxide, cadmium red, red lead, mercury sulfide, Watchung Red, Permanent Red 4R, Lithol Red, Brilliant Carmine 3B, Brilliant Carmine 6B, Oil Red, Pyrazolone Red, Rhodamine B Lake, Lake Red C, rose bengal, Eosine Red and Alizarin Lake.

Examples of a blue pigment include prussian blue, cobalt blue, Alkali Blue Lake, Victoria Blue Lake, Fast Sky Blue, Indanthrene Blue BC, Aniline Blue, Ultramarine Blue, Calco Oil Blue, methylene blue chloride, Phthalocyanine Blue, Phthalocyanine Green and malachite green oxalate.

Examples of a violet pigment include manganese violet, Fast Violet B and Methyl Violet Lake.

Examples of a green pigment include chromium oxide, chrome green, Pigment Green, Malachite Green Lake and Final Yellow Green G.

Examples of a white pigment include zinc white, titanium oxide, antimony white and zinc sulfide.

Examples of an extender pigment include barite powder, barium carbonate, clay, silica, white carbon, talc and alumina white.

Examples of a dye include various dyes, such as a basic dye, an acidic dye, a disperse dye and a direct dye, and examples thereof include Nigrosine, Methylene Blue, rose bengal, Quinoline Yellow and Ultramarine Blue.

The coloring agent may be used singly or as a mixture, as well as in the form of solid solution.

The coloring agent may be dispersed by a known method, and, for example, a media type disperser, such as a rotation shearing type homogenizer, a ball mill, a sand mill and an attritor, and a disperser of a high-pressure counter collision type are preferably used.

In the case where the coloring agent is dispersed in an aqueous system by the homogenizer using a surface active agent having a polarity, polar resin fine particles having an acid value of from 10 to 50 mg-KOH and a volume average particle diameter of from 100 nm or less may be added in an amount of from 0.4 to 10% by weight, preferably from 1.2 to 5.0% by weight of, to coat the coloring agent.

When the acid value of the polar resin fine particles is less than 10 mg-KOH, the Dispersibility of the coloring agent particles in the toner is difficult to be obtained, and when the acid value exceeds 50 mg-KOH, the polar resin itself forms a high dimensional structure, which may cause deterioration in fixing property of the toner although the Dispersibility is improved.

When the addition and attached amount of the polar resin fine particles is less than 0.4% by weight of coloring agent, they are attached to the coloring agent particles but are difficult to be uniformly attached, and as a result, it becomes difficult to suitably disperse the coloring agent in the toner. When it exceeds 10% by weight of coloring agent, the polar resin fine particles themselves are excessively aggregated, which may cause deterioration in transparency of the fixed image on an OHP sheet.

The coloring agent may be coated by the polar resin fine particles using a known method. Specifically, coloring agent particles and ion-exchanged water are suitably mixed to prepare a coloring agent particle dispersion by using the arbitrary disperser described above, and then polar resin fine particles are added and attached thereto. It is also possible that coloring agent particles and ion-exchanged water are suitably mixed and dispersed by using the arbitrary disperser described above, and then the polar resin fine particles are added, followed by being homogenized, to attach to the coloring agent particles. Furthermore, the polar resin fine particles may be added to the coloring agent particle dispersion at once or added stepwise, and it is preferred from the stand point of attachment property that it is preferred that they are gradually added dropwise.

The particle diameter of the coloring agent particles in the dispersion is measured by a laser defecation particle size distribution measurement apparatus LA-700 (produced by Horiba, Ltd.).

The coloring agent used in the invention is selected from the standpoint of hue, saturation, lightness, weather resistance, transparency on OHP and Dispersibility in the toner. The addition amount of the coloring agent is in a range of from 1 to 20% by weight per 100% by weight of the toner.

In the case where a magnetic material is used as a black coloring agent, it is added in an amount of from 30 to 100% by weight, which is different from the other coloring agent.

In the case where the toner of the invention is used a magnetic toner, magnetic powder may be added to the binder resin. As the magnetic powder, a substance that is magnetized in a magnetic field is employed. Specifically, ferromagnetic powder, such as iron, cobalt and nickel, and a compound, such as ferrite and magnetite may be used.

Particularly, in the invention, in order to obtain the toner in an aqueous layer, it is necessary to pay an attention to the transfer of the magnetic material to the aqueous layer, and it is preferred that the magnetic material is subjected to a surface modification, such as a treatment for imparting hydrophobic property.

In the invention, a charge controlling agent may be added to further improve and stabilize the charge property of the toner. As the charge controlling agent, a dye comprising a complex of a quaternary ammonium salt compound, a nigrosine series compound, aluminum, iron and chromium, and a triphenylmethane series pigment may be used, and a material that is difficult to be dissolved in water is preferred from the standpoint of control of the ion strength, which influences the stability on aggregation, fusing and uniting, and suppress of contamination of waste water.

In the invention, inorganic fine particles may be added in a wet state to stabilize the charge property of the toner. As an example of the inorganic fine particles include silica, those generally used as an external additive to the surface of the toner, such as alumina, titania, calcium carbonate, magnesium carbonate and tricalcium phosphate, may be used after dispersing in an ionic surface active agent, a polymeric acid or a polymeric base.

As similar to the production of the general toners, in order to endowing flowability and to improve the cleaning property, inorganic fine particles, such as silica, alumina, titania and calcium carbonate, and resin fine particles, such as a vinyl series resin, polyester and silicone, may be added to the surface of the toner with applying a shearing force under a dry condition, so as to be used as a flowability imparting assistant and a cleaning assistant.

In the process for producing a toner according to the invention, examples of the surface active agent, which is used in the emulsion polymerization of the resin fine particles, the dispersion of the coloring agent, the addition and dispersion of the resin fine particles, the dispersion of the releasing agent, the aggregation thereof and the stabilization thereof, include an anionic surface active agent, such as a sulfate ester series, a sulfonate ester series, a phosphate ester series and a soap series, and a cationic surface active agent, such as an amine salt series and a quaternary ammonium salt series. It is effective to use, in combination with the surface active agent described above, a nonionic surface active agent, such as a polyethylene glycol series, an alkylphenol ethyleneoxide adduct series and a polyvalent alcohol series. As the dispersion means for them, means generally employed, such as a rotation shearing type homogenizer, as well as a ball mill, a sand mill and a Dyno mill having a medium, may be used.

In the case where the coloring agent particles coated with the polar resin fine particles are used in the invention, a method, in which the resin and the coloring agent are dissolved and dispersed in a solvent (such as water, a surface active agent and an alcohol), and dispersed in water along with a suitable dispersant (including a surface active agent), and the solvent is removed by heating or subjecting to a reduced pressure, and a method, in which the coloring agent particles are fixed on the surface of the resin fine particles by a mechanical shearing force or an electric adsorption force, may be employed. These methods are effective to suppress release of the coloring agent added to the aggregated particles and to improve the dependency of the charge property on the coloring agent.

In the invention, the objective toner is obtained, after the completion of fusing and uniting, through a washing step, a solid-liquid separating step and a drying step, which may be arbitrary constituted, and it is preferred in the washing step that substitution washing with ion-exchanged water is sufficiently conducted to develop and maintain the charge property. While the solid-liquid separating step is not particularly limited, suction filtration and pressure filtration are preferably employed from the standpoint of productivity. While the drying step is also not particularly limited, freeze-drying, flash-jet drying, fluidized drying and vibration fluidized drying are preferably employed from the standpoint of productivity.

While the invention has been described, a preferred embodiment of the invention will be described below.

In a preferred embodiment, the invention relates to a toner for developing electrostatic charge excellent in peelability, adhesion of the fixed image, bending strength of the fixed image, Dispersibility of the releasing agent in the toner and transparency on an OHP sheet, and exhibiting durability of a high quality fixed image, and a process for producing the toner, the toner being produced by a process comprising the steps of: mixing at least a resin fine particle dispersion having resin fine particles having a diameter of 1 $\mu$m or less dispersed therein, a coloring agent particle dispersion and a releasing agent particle dispersion to form an aggregated particle dispersion of the resin fine particles and the coloring agent particles; and then heating to a temperature higher than a glass transition point of the resin fine particles to fuse and unite the particles, wherein the toner has an acid value of from 10 to 50 mg-KOH, and the toner has a relaxation modulus of elasticity G(t) at a relaxation time t=10×Dt (wherein Dt represents a heating time on fixing) obtained from measurement of dynamic viscoelasticity in a range of from $2.0\times10^2$ to $3.0\times10^3$ Pa, or the toner has a relaxation modulus of elasticity G(t=0.01) at a relaxation time of 0.01 sec obtained from measurement of dynamic viscoelasticity in a range of from $2.0\times10^2$ to $3.0\times10^4$ Pa, and a ratio G(r)

(G(t=0.01)/G(t=0.1)) of the relaxation modulus of elasticity G(t=0.01) to a relaxation modulus of elasticity G(t=0.1) at a relaxation time of 0.1 sec in a range of from 1.0 to 18.0.

In another preferred embodiment, the invention relates to a toner for developing electrostatic charge, in which the molten behavior on fixing of the toner can be controlled, the peelability of a receiving sheet, the adhesion of the fixed image and the bending strength of the fixed image are excellent, the Dispersibility and encompassment of the releasing agent particles and the coloring agent particles contained in the toner are high, and the minuteness of the image quality is high, and a process for producing the toner, the toner being produced by a process comprising the steps of: mixing at least a resin fine particle dispersion having resin fine particles having a diameter of 1 $\mu$m or less dispersed therein, a coloring agent particle dispersion and a releasing agent particle dispersion; adding an inorganic metallic salt thereto to form an aggregate of the resin particles and the coloring agent particles; terminating the aggregation under an alkaline condition; and then heating to a temperature higher than a glass transition point of the resin fine particles to fuse and unite the particles, wherein the toner has an acid value of from 10 to 50 mg-KOH, the coloring agent particles having a mean particle diameter measured by a transmission electron microscope (TEM) of from 100 to 330 nm in a dispersed state are added in an amount of from 4 to 15% by weight of toner, and the toner has a relaxation modulus of elasticity G(t) at a relaxation time t=10×Dt (wherein Dt represents a heating time on fixing) obtained from measurement of dynamic viscoelasticity in a range of from $2.0\times10^2$ to $3.0\times10^3$ Pa, or the toner has a relaxation modulus of elasticity G(t=0.01) at a relaxation time of 0.01 sec obtained from measurement of dynamic viscoelasticity in a range of from $2.0\times10^2$ to $3.0\times10^4$ Pa, and a ratio G(r) (G(t=0.01)/G(t=0.1)) of the relaxation modulus of elasticity G(t=0.01) to a relaxation modulus of elasticity G(t=0.1) at a relaxation time of 0.1 sec in a range of from 1.0 to 18.0.

While the invention will be described in more detail with reference to the following examples, the invention is not construed as being limited thereto.

A toner according to the invention was produced by the following manner. That is, the resin fine particle dispersion, the coloring agent particle dispersion and the releasing agent particle dispersion described below were prepared, and prescribed amounts thereof were mixed with each other while ionically neutralizing by adding a polymer of an inorganic metallic salt, to form an aggregate of the particles described above. After adjusting the pH of the system from a weakly acidic state to a neutral state by an inorganic hydroxide, it was heated to a temperature higher than the glass transition point of the resin fine particles to fuse and unite. Thereafter, an objective toner was obtained through sufficient washing, solid-liquid separation and drying steps.

Specific examples of the preparation method of the materials, and the formation method of the aggregated particles are described below.

(Preparation of Resin Fine Particle Dispersion)

| | |
|---|---|
| Styrene | 320 parts by weight |
| n-Butyl acrylate | 80 parts by weight |
| Acrylic acid | 6 parts by weight |

-continued

| | |
|---|---|
| Dodecane thiol | 20 parts by weight |
| Carbon tetrabromide | 4 parts by weight |

The components described above were mixed and dissolved. Separately, a solution obtained by dissolving 6 g of a nonionic surface active agent Nonipole 400 (produced by Kao Corp.) and 10 g of an anionic surface active agent Neogen SC (produced by Dai-ichi Kogyo Seiyaku Co., Ltd.) in 500 g of ion-exchanged water was placed in a flask, to which the mixed solution obtained above was added, followed by being emulsified by dispersing. While it was slowly stirred and mixed for 10 minutes, 50 g of ion-exchanged water, in which 4 g of ammonium persulfate had been dissolved, was added thereto. After sufficiently replacing the system with nitrogen, the system was heated until the system reached 70° C. by an oil bath with stirring the flask, the emulsion polymerization was continued for 5 hours.

An anionic resin fine particle dispersion comprising resin fine particles having a mean particle diameter of 160 nm, a glass transition point of 58° C. and a weight average molecular weight Mw of 35,000 was obtained.

(Preparation of Polar Resin Fine Particles for Coating Coloring Agent Particles)

| | |
|---|---|
| Acrylic acid | 6 parts by weight |
| Ethyl acrylate | 70 parts by weight |
| Styrene | 24 parts by weight |

The components described above were mixed and dissolved. Separately, a solution obtained by dissolving 6 g of a nonionic surface active agent Nonipole 400 (produced by Kao Corp.) and 10 g of an anionic surface active agent Neogen SC (produced by Dai-ichi Kogyo Seiyaku Co., Ltd.) in 550 g of ion-exchanged water was placed in a flask, to which the mixed solution obtained above was added, followed by being emulsified by dispersing. While it was slowly stirred and mixed for 10 minutes, 50 g of ion-exchanged water, in which 1 g of ammonium persulfate had been dissolved, was added thereto. After sufficiently replacing the system with nitrogen, the system was heated until the system reached 70° C. by an oil bath with stirring the flask, the emulsion polymerization was continued for 5 hours.

A cationic resin fine particle dispersion comprising polar resin fine particles having a mean particle diameter of 60 nm, a glass transition point of −8° C. and Mw of 120,000 was obtained. The acid value of the polar resin fine particles was 40 mg.

(Preparation of Coloring Agent Particle Dispersion 1)

| | |
|---|---|
| Yellow pigment PY180 (produced by Clariant Japan, Co., Ltd.) | 50 parts by weight |
| Nonionic surface active agent Nonipole 400 (produced by Kao Corp.) | 5 parts by weight |
| Ion-exchanged water | 200 parts by weight |

The components described above were mixed and dissolved, and dispersed for 10 minutes by a homogenizer (Ultra-Turrax produced by IKA Works, Inc.) to obtain a coloring agent particle dispersion having a mean particle diameter of 168 nm. 0.47 part by weight of polar resin particles having an acid value of 40 mg-KOH and a particle diameter of 60 nm was carefully added dropwise thereto, and it was again treated by the homogenizer (Ultra-Turrax produced by IKA Works, Inc.) for 5 minutes to adhere thereto. The coloring agent particles was dried and observed with an SEM, and it was observed that the polar resin fine particles were uniformly attached around the coloring agent. The diameter of the coloring agent dispersed particles was 175 nm.

(Preparation of Coloring Agent Particle Dispersion 2)

A dispersion containing coloring agent particles having a mean particle diameter of 167 nm dispersed therein was obtained in the same manner as in the preparation of the coloring agent particle dispersion 1 except that a cyan pigment (copper phthalocyanine B15:3 produced by Dainichiseika Color & Chemicals Mfg. Co., Ltd.) was used as the coloring agent.

(Preparation of Coloring Agent Particle Dispersion 3)

A dispersion containing coloring agent particles having a mean particle diameter of 186 nm dispersed therein was obtained in the same manner as in the preparation of the coloring agent particle dispersion 1 except that a magenta pigment (PR122 produced by Dainippon Ink and Chemicals, Inc.) was used as the coloring agent.

(Preparation of Coloring Agent Particle Dispersion 4)

A dispersion containing coloring agent particles having a mean particle diameter of 159 nm dispersed therein was obtained in the same manner as in the preparation of the coloring agent particle dispersion 1 except that a black pigment (carbon black produced by Cabot, Inc.) was used as the coloring agent.

(Preparation of Coloring Agent Particle Dispersion 5)

A dispersion containing coloring agent particles having a mean particle diameter of 168 nm dispersed therein was obtained in the same manner as in the preparation of the coloring agent particle dispersion 1 except that the addition of the polar resin fine particles was omitted.

(Preparation of Releasing Agent Particle Dispersion 1)

| | |
|---|---|
| Paraffin wax HNP0190 (melting point: 85° C., produced by Nippon Seiro Co., Ltd.) | 50 parts by weight |
| Cationic surface active agent Sanisol (produced by Kao Corp.) | 5 parts by weight |
| Ion-exchanged water | 200 parts by weight |

The components described above were heated to 95° C. and sufficiently dispersed by Ultra-Turrax T50 produced by IKA Works, Inc. It was then subjected to a dispersion treatment by a pressure-discharge homogenizer, to obtain a releasing agent particle dispersion having a mean particle diameter of 180 nm.

EXAMPLE 1

| | |
|---|---|
| Resin fine particle dispersion | 200 parts by weight |
| Coloring agent particle dispersion 1 | 80 parts by weight |
| Releasing agent particle dispersion | 50 parts by weight |
| Polyaluminum chloride | 1.23 parts by weight |

The components described above were sufficiently mixed and dispersed in a round flask made with stainless steel by using Ultra-Turrax T50 produced by IKA Works, Inc., and heated to 51° C. on a heating oil bath with stirring the flask. After maintaining at 51° C. for 60 minutes, 60 parts by weight of the same resin fine particle dispersion was further gradually added thereto.

After the pH of the system was adjusted to 6.5 by using a sodium hydroxide aqueous solution having a concentration of 0.5 mol/L, the flask made with stainless steel was sealed, and it was heated to 97° C. and maintained for 3 hours with continuing stirring where the stirring axis was sealed by a magnetic seal. After completion of the reaction, the system was subjected to cooling, filtration and sufficient washing with ion-exchanged water, and solid-liquid separation was conducted by suction filtration using a Nutsche funnel. The solid component was again dispersed in 3 L of ion-exchanged water at 40° C. and stirred and washed for 15 minutes at 300 rpm. The washing operation was repeated 5 times, and when the filtrate exhibited a pH of 6.54, an electroconductivity of 6.4 $\mu$S/cm and a surface tension of 71.2 $kmol^{-1}$, solid-liquid separation was conducted by suction filtration using a Nutsche funnel with filter paper No. 5A. It was subjected vacuum drying for 12 hours to obtain a toner.

The measurement of a Coulter Counter revealed that the toner had a volume average particle diameter $D_{50}$ of 6.2 $\mu$m and a volume average particle diameter distribution coefficient GSDv of 1.20. The ratio (GSDv/GSDp) of the volume average particle diameter distribution coefficient GSDv to the number average particle diameter distribution coefficient GSDp was 1.10. The toner was subjected to shape observation by using a LUZEX image analyzing device produced by LUZEX, Inc., and it was observed that the shape factor SF1 of the particles was 130, which was a roundish potato-like shape. From a cross sectional image of the toner obtained from the observation by a scanning electron microscope (SEM), the releasing agent particles were uniformly dispersed in the toner particles, and the arithmetic average mean particle diameter thereof was 200 nm with the mean particle diameter of the coloring agent particles being 176 nm, i.e., the dispersion system in the coloring agent particle dispersion was substantially maintained. The acid value of the toner was measured, and it was 18 mg-KOH.

The toner was subjected to measurement of dynamic viscoelasticity, and it was found that the relaxation modulus of elasticity G(t) at a fixing time of 100 msec and a fixing temperature of 160° C. was $2.9\times10^2$ Pa, the relaxation modulus of elasticity G(t=0.01) at a relaxation time of 0.01 sec was $5.1\times10^3$ Pa, and the ratio G(r) (G(t=0.01)/G(t=0.1)) of the relaxation modulus of elasticity G(t=0.01) at a relaxation time of 0.01 sec to a relaxation modulus of elasticity G(t=0.1) at a relaxation time of 0.1 sec was 17.8. That is, the coloring agent particles and the releasing agent particles did not form a structure of aggregation in the toner but exhibited good dispersed state.

The charge property of the toner was measured, and the toner exhibited good charge property of −27 $\mu$C/g under a condition of 23° C. and 60% RH, −29 $\mu$C/g under a condition of 10° C. and 30% RH, and −24 $\mu$C/g under a condition of 28° C. and 85% RH.

EXAMPLE 2

A toner was obtained in the same manner as in Example 1 except that a coloring agent dispersion prepared in Preparation of Coloring Agent Particle Dispersion 1 was used, the amount of the releasing agent was changed to 24 parts by weight of coloring agent dispersion, and the pH at the completion of aggregation was changed from 6.5 to 4.2.

The volume average particle diameter $D_{50}$ of the toner measured by a Coulter Counter was 6.0 $\mu$m, and the volume average particle diameter distribution coefficient GSDv was 1.22. The ratio (GSDv/GSDp) of the volume average particle diameter distribution coefficient GSDv to the number average particle diameter distribution coefficient GSDp was 1.01.

The toner was subjected to shape observation by using a LUZEX image analyzing device, and it was observed that the shape factor SF1 of the particle was 112, i.e., a spherical shape. From the observation of the cross sectional image of the toner with a scanning electron microscope (SEM), the releasing agent particles were dispersed in the toner particles and had an arithmetic average mean particle diameter of 360 nm, and the mean particle diameter of the coloring agent particle was 194 nm. The acid value of the toner was 19 mg-KOH.

The toner was subjected to measurement of dynamic viscoelasticity, and it was found that the relaxation modulus of elasticity G(t) at a fixing time of 40 msec and a fixing temperature of 150° C. was $8.1\times10^3$ Pa, the relaxation modulus of elasticity G(t=0.01) at a relaxation time of 0.01 sec was $7.2\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 3.6. That is, the coloring agent particles and the releasing agent particles did not form the structure in the toner.

The charge property of the toner was measured, and the toner exhibited good charge property of −29 μC/g under a condition of 23° C. and 60% RH, −30 μC/g under a condition of 10° C. and 30% RH, and −25 μC/g under a condition of 28° C. and 85% RH.

EXAMPLE 3

A toner was obtained in the same manner as in Example 1 except that a coloring agent dispersion prepared in Preparation of Coloring Agent Particle Dispersion 1 was used, and the pH at the completion of aggregation was changed from 6.5 to 7.2.

The volume average particle diameter $D_{50}$ of the toner measured by a Coulter Counter was 5.7 μm, and the volume average particle diameter distribution coefficient GSDv was 1.19. The ratio (GSDv/GSDp) of the volume average particle diameter distribution coefficient GSDv to the number average particle diameter distribution coefficient GSDp was 0.99.

The toner was subjected to shape observation by using a LUZEX image analyzing device, and it was observed that the shape factor SF1 of the particle was 140, i.e., a potato-like shape. From the observation of the cross sectional image of the toner with a scanning electron microscope (SEM), the releasing agent particles were dispersed in the toner particles and had an arithmetic average mean particle diameter of 180 nm, and the mean particle diameter of the coloring agent particle was 175 nm. Accordingly, the dispersed system in the coloring agent particle dispersion was substantially maintained. The acid value of the toner was 18 mg-KOH.

The toner was subjected to measurement of dynamic viscoelasticity, and it was found that the relaxation modulus of elasticity G(t) at a fixing time of 240 msec and a fixing temperature of 160° C. was $2.8\times10^3$ Pa, the relaxation modulus of elasticity G(t=0.01) at a relaxation time of 0.01 sec was $5.8\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 3.2. That is, the coloring agent particles and the releasing agent particles did not form the structure in the toner.

The charge property of the toner was measured, and the toner exhibited good charge property of −28 μC/g under a condition of 23° C. and 60% RH, −32 μC/g under a condition of 10° C. and 30% RH, and −27 μC/g under a condition of 28° C. and 85% RH.

EXAMPLE 4

A toner was obtained in the same manner as in Example 1 except that in Preparation of Coloring Agent Particle Dispersion 1, the addition amount of the polar resin fine particle dispersion was changed from 0.47 part by weight to 5.0 parts by weight, and the amount of the coloring agent was changed to 92 parts by weight of coloring agent dispersion.

The volume average particle diameter $D_{50}$ of the toner measured by a Coulter Counter was 5.7 μm, and the volume average particle diameter distribution coefficient GSDv was 1.19. The ratio (GSDv/GSDp) of the volume average particle diameter distribution coefficient GSDv to the number average particle diameter distribution coefficient GSDp was 1.03.

The toner was subjected to shape observation by using a LUZEX image analyzing device, and it was observed that the shape factor SF1 of the particle was 131, i.e., a roundish potato-like shape. From the observation of the cross sectional image of the toner with a scanning electron microscope (SEM), the releasing agent particles were dispersed in the toner particles and had an arithmetic average mean particle diameter of 240 nm, and the mean particle diameter of the coloring agent particle was 160 nm. Accordingly, the dispersed system in the coloring agent particle dispersion was substantially maintained. The acid value of the toner was 49.9 mg-KOH.

The toner was subjected to measurement of dynamic viscoelasticity, and it was found that the relaxation modulus of elasticity G(t) at a fixing time of 15 msec and a fixing temperature of 160° C. was $2.4\times10^3$ Pa, the relaxation modulus of elasticity G(t=0.01) at a relaxation time of 0.01 sec was $7.3\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 13.0. That is, the coloring agent particles and the releasing agent particles did not form the structure in the toner.

The charge property of the toner was measured, and the toner exhibited good charge property of −30 μC/g under a condition of 23° C. and 60% RH, −31 μC/g under a condition of 10° C. and 30% RH, and −28 μC/g under a condition of 28° C. and 85% RH.

EXAMPLE 5

A toner was obtained in the same manner as in Example 1 except that in Preparation of Coloring Agent Particle Dispersion 1, the addition amount of the polar resin fine particle dispersion was changed from 0.47 part by weight to 2.5 parts by weight, the amount of the releasing agent was changed to 116 parts by weight, and the amount of the coloring agent was changed to 70 parts by weight.

The volume average particle diameter $D_{50}$ of the toner measured by a Coulter Counter was 5.7 μm, and the volume average particle diameter distribution coefficient GSDv was 1.20. The ratio (GSDv/GSDp) of the volume average particle diameter distribution coefficient GSDv to the number average particle diameter distribution coefficient GSDp was 1.0.

The toner was subjected to shape observation by using a LUZEX image analyzing device, and it was observed that the shape factor SF1 of the particle was 131, i.e., a roundish potato-like shape. From the observation of the cross sectional image of the toner with a scanning electron microscope (SEM), the releasing agent particles were dispersed in the toner particles and had an arithmetic average mean particle diameter of 240 nm, and the mean particle diameter of the coloring agent particle was 160 nm. Accordingly, the dispersed system in the coloring agent particle dispersion was substantially maintained. The acid value of the toner was 38 mg-KOH.

The toner was subjected to measurement of dynamic viscoelasticity, and it was found that the relaxation modulus of elasticity G(t) at a fixing time of 230 msec and a fixing temperature of 160° C. was $4.8\times10^3$ Pa, the relaxation modulus of elasticity G(t=0.01) at a relaxation time of 0.01 sec was $1.1\times10^4$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 5.5. That is, the coloring agent particles and the releasing agent particles did not form the structure in the toner.

The charge property of the toner was measured, and the toner exhibited good charge property of −32 μC/g under a condition of 23° C. and 60% RH, −36 μC/g under a condition of 10° C. and 30% RH, and −28 μC/g under a condition of 28° C. and 85% RH.

EXAMPLE 6

A toner was obtained in the same manner as in Example 1 except that the coloring agent dispersion was changed from one obtained in Preparation of Coloring Agent Particle Dispersion 1 to one obtained in Coloring Agent Particle Dispersion 3, and the amount of the coloring agent was changed to 21 parts by weight.

The volume average particle diameter $D_{50}$ of the toner measured by a Coulter Counter was 5.9 μm, and the volume average particle diameter distribution coefficient GSDv was 1.18. The ratio (GSDv/GSDp) of the volume average particle diameter distribution coefficient GSDv to the number average particle diameter distribution coefficient GSDp was 1.00.

The toner was subjected to shape observation by using a LUZEX image analyzing device, and it was observed that the shape factor SF1 of the particle was 134, i.e., a roundish potato-like shape. From the observation of the cross sectional image of the toner with a scanning electron microscope (SEM), the releasing agent particles were uniformly dispersed in the toner particles and had an arithmetic average mean particle diameter of 260 nm, and the mean particle diameter of the coloring agent particle was 172 nm. The acid value of the toner was 19 mg-KOH.

The toner was subjected to measurement of dynamic viscoelasticity, and it was found that the relaxation modulus of elasticity G(t) at a fixing time of 28 msec and a fixing temperature of 150° C. was $4.3\times10^2$ Pa, the relaxation modulus of elasticity G(t=0.01) at a relaxation time of 0.01 sec was $2.2\times10^2$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 6.0. That is, the coloring agent particles and the releasing agent particles did not form the structure in the toner.

The charge property of the toner was measured, and the toner exhibited good charge property of −28 μC/g under a condition of 23° C. and 60% RH, −30 μC/g under a condition of 10° C. and 30% RH, and −25 μC/g under a condition of 28° C. and 85% RH.

EXAMPLE 7

A toner was obtained in the same manner as in Example 1 except that the coloring agent dispersion was changed from one obtained in Preparation of Coloring Agent Particle Dispersion 1 to one obtained in Coloring Agent Particle Dispersion 4.

The volume average particle diameter $D_{50}$ of the toner measured by a Coulter Counter was 6.1 μm, and the volume average particle diameter distribution coefficient GSDv was 1.22. The ratio (GSDv/GSDp) of the volume average particle diameter distribution coefficient GSDv to the number average particle diameter distribution coefficient GSDp was 0.94.

The toner was subjected to shape observation by using a LUZEX image analyzing device, and it was observed that the shape factor SF1 of the particle was 130, i.e., a roundish potato-like shape. From the observation of the cross sectional image of the toner with a scanning electron microscope (SEM), the releasing agent particles were uniformly dispersed in the toner particles and had an arithmetic average mean particle diameter of 255 nm, and the mean particle diameter of the coloring agent particle was 196 nm. Accordingly, the dispersed system in the coloring agent particle dispersion was substantially maintained. The acid value of the toner was 19 mg-KOH.

The toner was subjected to measurement of dynamic viscoelasticity, and it was found that the relaxation modulus of elasticity G(t) at a fixing time of 31 msec and a fixing temperature of 150° C. was $6.1\times10^2$ Pa, the relaxation modulus of elasticity G(t=0.01) at a relaxation time of 0.01 sec was $9.8\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 5.0. That is, the coloring agent particles and the releasing agent particles did not form the structure in the toner.

The charge property of the toner was measured, and the toner exhibited good charge property of −29 μC/g under a condition of 23° C. and 60% RH, −33 μC/g under a condition of 10° C. and 30% RH, and −27 μC/g under a condition of 28° C. and 85% RH.

EXAMPLE 8

A toner was obtained in the same manner as in Example 1 except that the coloring agent dispersion was changed from one obtained in Preparation of Coloring Agent Particle Dispersion 1 to one obtained in Coloring Agent Particle Dispersion 4, and the amount thereof was changed to 24 parts by weight.

The volume average particle diameter $D_{50}$ of the toner measured by a Coulter Counter was 6.5 μm, and the volume average particle diameter distribution coefficient GSDv was 1.24. The ratio (GSDv/GSDp) of the volume average particle diameter distribution coefficient GSDv to the number average particle diameter distribution coefficient GSDp was 1.25.

The toner was subjected to shape observation by using a LUZEX image analyzing device, and it was observed that the shape factor SF1 of the particle was 131, i.e., a roundish potato-like shape. From the observation of the cross sectional image of the toner with a scanning electron microscope (SEM), the releasing agent particles were uniformly dispersed in the toner particles and had an arithmetic average mean particle diameter of 260 nm, and the mean particle diameter of the coloring agent particle was 121 nm.

Accordingly, the dispersed system in the coloring agent particle dispersion was substantially maintained. The acid value of the toner was 22 mg-KOH.

The toner was subjected to measurement of dynamic viscoelasticity, and it was found that the relaxation modulus of elasticity G(t) at a fixing time of 60 msec and a fixing temperature of 150° C. was $8.0\times10^2$ Pa, the relaxation modulus of elasticity G(t=0.01) at a relaxation time of 0.01 sec was $3.6\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 4.3. That is, the coloring agent particles and the releasing agent particles did not form the structure in the toner.

The charge property of the toner was measured, and the toner exhibited good charge property of −25 μC/g under a condition of 23° C. and 60% RH, −25 μC/g under a condition of 10° C. and 30% RH, and −22 μC/g under a condition of 28° C. and 85% RH.

EXAMPLE 9

A toner was obtained in the same manner as in Example 1 except that the coloring agent dispersion obtained in Preparation of Coloring Agent Particle Dispersion 1 was used, and the coalescence conditions were changed from 97° C. for 3 hours to 41° C. for 16 hours.

The volume average particle diameter $D_{50}$ of the toner measured by a Coulter Counter was 4.1 μm, and the volume average particle diameter distribution coefficient GSDv was 1.23. The ratio (GSDv/GSDp) of the volume average particle diameter distribution coefficient GSDv to the number average particle diameter distribution coefficient GSDp was 1.29.

The toner was subjected to shape observation by using a LUZEX image analyzing device, and it was observed that the shape factor SF1 of the particle was 129, i.e., a roundish potato-like shape. From the observation of the cross sectional image of the toner with a scanning electron microscope (SEM), the releasing agent particles were uniformly dispersed in the toner particles and had an arithmetic average mean particle diameter of 180 nm, and the mean particle diameter of the coloring agent particle was 115 nm. Accordingly, the dispersed system in the coloring agent particle dispersion was substantially maintained. The acid value of the toner was 17 mg-KOH.

The toner was subjected to measurement of dynamic viscoelasticity, and it was found that the relaxation modulus of elasticity G(t) at a fixing time of 40 msec and a fixing temperature of 150° C. was $9.2\times10^2$ Pa, the relaxation modulus of elasticity G(t=0.01) at a relaxation time of 0.01 sec was $2.1\times10^4$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 1.1. That is, the coloring agent particles and the releasing agent particles did not form an aggregated body but were well dispersed in the toner.

The charge property of the toner was measured, and the toner exhibited good charge property of −25 μC/g under a condition of 23° C. and 60% RH, −25 μC/g under a condition of 10° C. and 30% RH, and −22 μC/g under a condition of 28° C. and 85% RH.

EXAMPLE 10

A toner was obtained in the same manner as in Example 1 except that the addition amount of the coloring agent dispersion was changed from 80 parts by weight to 15 parts by weight, and in Preparation of Coloring Agent Particle Dispersion 1, the addition amount of the polar resin fine particle dispersion was changed from 0.47 part by weight to 2.5 parts by weight.

The volume average particle diameter $D_{50}$ of the toner measured by a Coulter Counter was 5.8 μm, and the volume average particle diameter distribution coefficient GSDv was 1.23. The ratio (GSDv/GSDp) of the volume average particle diameter distribution coefficient GSDv to the number average particle diameter distribution coefficient GSDp was 0.96.

The toner was subjected to shape observation by using a LUZEX image analyzing device, and it was observed that the shape factor SF1 of the particle was 130, i.e., a roundish potato-like shape. From the observation of the cross sectional image of the toner with a scanning electron microscope (SEM), the releasing agent particles were dispersed in the toner particles and had an arithmetic average mean particle diameter of 270 nm, and the mean particle diameter of the coloring agent particle was 183 nm. Accordingly, the dispersed system in the coloring agent particle dispersion was substantially maintained. The acid value of the toner was 14 mg-KOH.

The toner was subjected to measurement of dynamic viscoelasticity, and it was found that the relaxation modulus of elasticity G(t) at a fixing time of 48 msec and a fixing temperature of 160° C. was $7.8\times10^2$ Pa, the relaxation modulus of elasticity G(t=0.01) at a relaxation time of 0.01 sec was $6.3\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 3.2. That is, the coloring agent particles and the releasing agent particles did not form the structure in the toner.

The charge property of the toner was measured, and the toner exhibited good charge property of −28 μC/g under a condition of 23° C. and 60% RH, −30 μC/g under a condition of 10° C. and 30% RH, and −25 μC/g under a condition of 28° C. and 85% RH.

EXAMPLE 11

A toner was obtained in the same manner as in Example 1 except that the aggregation conditions were changed from 51° C. for 60 minutes to 61° C. for 60 minutes, the pH of the system at the completion of aggregation was changed from 6.5 to 5.8, and the conditions for fusing and uniting were changed from 97° C. for 3 hours to 97° C. for 10 hours.

The volume average particle diameter $D_{50}$ of the toner measured by a Coulter Counter was 7.4 μm, and the volume average particle diameter distribution coefficient GSDv was 1.22. The ratio (GSDv/GSDp) of the volume average particle diameter distribution coefficient GSDv to the number average particle diameter distribution coefficient GSDp was 1.14.

The toner was subjected to shape observation by using a LUZEX image analyzing device, and it was observed that the shape factor SF1 of the particle was 118, i.e., a roundish potato-like shape. From the observation of the cross sectional image of the toner with a scanning electron microscope (SEM) the releasing agent particles were uniformly dispersed in the toner particles and had an arithmetic average mean particle diameter of 730 nm, and the mean particle diameter of the coloring agent particle was 188 nm. Accordingly, the dispersed system in the coloring agent particle dispersion was substantially maintained. The acid value of the toner was 17 mg-KOH.

The toner was subjected to measurement of dynamic viscoelasticity, and it was found that the relaxation modulus of elasticity G(t) at a fixing time of 35 msec and a fixing temperature of 150° C. was $7.2\times10^2$ Pa, the relaxation modulus of elasticity G(t=0.01) at a relaxation time of 0.01 sec was $5.1\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 1.30. That is, the coloring agent particles and the releasing agent particles did not form the structure in the toner.

The charge property of the toner was measured, and the toner exhibited good charge property of −27 μC/g under a condition of 23° C. and 60% RH, −29 μC/g under a condition of 10° C. and 30% RH, and −23 μC/g under a condition of 28° C. and 85% RH.

EXAMPLE 12

A toner was obtained in the same manner as in Example 1 except that in Preparation of Coloring Agent Particle Dispersion 1, the addition amount of the coloring agent dispersion was changed from 80 parts by weight to 5 parts by weight.

The volume average particle diameter $D_{50}$ of the toner measured by a Coulter Counter was 6.2 μm, and the volume average particle diameter distribution coefficient GSDv was 1.21. The ratio (GSDv/GSDp) of the volume average particle diameter distribution coefficient GSDv to the number average particle diameter distribution coefficient GSDp was 0.93.

The toner was subjected to shape observation by using a LUZEX image analyzing device, and it was observed that the shape factor SF1 of the particle was 134, i.e., a roundish potato-like shape. From the observation of the cross sectional image of the toner with a scanning electron microscope (SEM), the releasing agent particles were dispersed in the toner particles and had an arithmetic average mean particle diameter of 730 nm, and the mean particle diameter of the coloring agent particle was 188 nm. Accordingly, the dispersed system in the coloring agent particle dispersion was substantially maintained. The acid value of the toner was 16 mg-KOH.

The toner was subjected to measurement of dynamic viscoelasticity, and it was found that the relaxation modulus of elasticity G(t) at a fixing time of 26 msec and a fixing temperature of 160° C. was $2.0\times10^2$ Pa, the relaxation modulus of elasticity G(t=0.01) at a relaxation time of 0.01 sec was $2.4\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 1.1. That is, the coloring agent particles and the releasing agent particles did not form the structure in the toner.

The charge property of the toner was measured, and the toner exhibited good charge property of −26 μC/g under a condition of 23° C. and 60% RH, −29 μC/g under a condition of 10° C. and 30% RH, and −24 μC/g under a condition of 28° C. and 85% RH.

EXAMPLE 13

A toner was obtained in the same manner as in Example 1 except that the addition amount of the releasing agent dispersion was changed from 50 parts by weight to 25 parts by weight, and the aggregation time was changed from 1 hour to 4 hours.

The volume average particle diameter $D_{50}$ of the toner measured by a Coulter Counter was 9.0 μm, and the volume average particle diameter distribution coefficient GSDv was 1.24. The ratio (GSDv/GSDp) of the volume average particle diameter distribution coefficient GSDv to the number average particle diameter distribution coefficient GSDp was 0.86.

The toner was subjected to shape observation by using a LUZEX image analyzing device, and it was observed that the shape factor SF1 of the particle was 137, i.e., a roundish potato-like shape. From the observation of the cross sectional image of the toner with a scanning electron microscope (SEM), the releasing agent particles were uniformly dispersed in the toner particles and had an arithmetic average mean particle diameter of 360 nm, and the mean particle diameter of the coloring agent particle was 197 nm. Accordingly, the dispersed system in the coloring agent particle dispersion was substantially maintained. The acid value of the toner was 21 mg-KOH.

The toner was subjected to measurement of dynamic viscoelasticity, and it was found that the relaxation modulus of elasticity G(t) at a fixing time of 45 msec and a fixing temperature of 150° C. was $1.7\times10^3$ Pa, the relaxation modulus of elasticity G(t=0.01) at a relaxation time of 0.01 sec was $9.6\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 10.1. That is, the coloring agent particles and the releasing agent particles did not form the structure in the toner.

The charge property of the toner was measured, and the toner exhibited good charge property of −26 μC/g under a condition of 23° C. and 60% RH, −28 μC/g under a condition of 10° C. and 30% RH, and −25 μC/g under a condition of 28° C. and 85% RH.

EXAMPLE 14

A toner was obtained in the same manner as in Example 1 except that the addition amount of the releasing agent dispersion was changed from 50 parts by weight to 5 parts by weight.

The volume average particle diameter $D_{50}$ of the toner measured by a Coulter Counter was 6.1 μm, and the volume average particle diameter distribution coefficient GSDv was 1.21. The ratio (GSDv/GSDp) of the volume average particle diameter distribution coefficient GSDv to the number average particle diameter distribution coefficient GSDp was 1.11.

The toner was subjected to shape observation by using a LUZEX image analyzing device, and it was observed that the shape factor SF1 of the particle was 129, i.e., a roundish potato-like shape. From the observation of the cross sectional image of the toner with a scanning electron microscope (SEM), the releasing agent particles were uniformly dispersed in the toner particles and had an arithmetic average mean particle diameter of 240 nm, and the mean particle diameter of the coloring agent particle was 173 nm. Accordingly, the dispersed system in the coloring agent particle dispersion was substantially maintained. The acid value of the toner was 12 mg-KOH.

The toner was subjected to measurement of dynamic viscoelasticity, and it was found that the relaxation modulus of elasticity G(t) at a fixing time of 60 msec and a fixing temperature of 160° C. was $9.6\times10^2$ Pa, the relaxation modulus of elasticity G(t=0.01) at a relaxation time of 0.01 sec was $9.6\times10^3$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 3.4. That is, the coloring agent particles and the releasing agent particles did not form the structure in the toner.

The charge property of the toner was measured, and the toner exhibited good charge property of −27 μC/g under a condition of 23° C. and 60% RH, −28 μC/g under a condition of 10° C. and 30% RH, and −27 μC/g under a condition of 28° C. and 85% RH.

Comparative Example 1

A toner was obtained in the same manner as in Example 1 except that the coloring agent dispersion was changed from one obtained in Preparation of Coloring Agent Particle Dispersion 1 to one obtained in Coloring Agent Particle Dispersion 5 (in which coating of the polar resin fine particles on the coloring agent was omitted).

The volume average particle diameter $D_{50}$ of the toner measured by a Coulter Counter was 6.8 μm, and the volume average particle diameter distribution coefficient GSDv was 1.22. The ratio (GSDv/GSDp) of the volume average particle diameter distribution coefficient GSDv to the number average particle diameter distribution coefficient GSDp was 1.01.

The toner was subjected to shape observation by using a LUZEX image analyzing device, and it was observed that the shape factor SF1 of the particle was 133, i.e., a roundish potato-like shape. From the observation of the cross sectional image of the toner with a scanning electron microscope (SEM), the releasing agent particles were partly aggregated in the toner particles and had an arithmetic average mean particle diameter of 1,390 nm, and the mean particle diameter of the coloring agent particle was 270 nm. Accordingly, the dispersed system in the coloring agent particle dispersion was substantially maintained. The acid value of the toner was 9.8 mg-KOH.

The toner was subjected to measurement of dynamic viscoelasticity, and it was found that the relaxation modulus of elasticity G(t) at a fixing time of 60 msec and a fixing temperature of 160° C. was $4.8\times10^3$ Pa, the relaxation modulus of elasticity G(t=0.01) at a relaxation time of 0.01 sec was $4.2\times10^2$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 0.8. That is, the coloring agent particles and the releasing agent particles formed the structure in the toner.

The charge property of the toner was measured, and the toner exhibited good charge property of −24 μC/g under a condition of 23° C. and 60% RH, −39 μC/g under a condition of 10° C. and 30% RH, and −26 μC/g under a condition of 28° C. and 85% RH.

Comparative Example 2

A toner was obtained in the same manner as in Example 1 except that the addition amount of the coloring agent dispersion obtained in Preparation of Coloring Agent Particle Dispersion 1 was changed from 80 parts by weight to 16.5 parts by weight, and the additional amount of the resin fine particle dispersion was changed from 60 parts by weight to 15 parts by weight.

The volume average particle diameter $D_{50}$ of the toner measured by a Coulter Counter was 8.1 μm, and the volume average particle diameter distribution coefficient GSDv was 1.25. The ratio (GSDv/GSDp) of the volume average particle diameter distribution coefficient GSDv to the number average particle diameter distribution coefficient GSDp was 1.27.

The toner was subjected to shape observation by using a LUZEX image analyzing device, and it was observed that the shape factor SF1 of the particle was 140, i.e., an irregular shape. From the observation of the cross sectional image of the toner with a scanning electron microscope (SEM), the releasing agent particles were dispersed in the toner particles, but aggregated bodies of the polar resin particles were formed in the toner particles. The arithmetic average mean particle diameter of the releasing agent was 270 nm, and the mean particle diameter of the coloring agent particle was 191 nm. Accordingly, the dispersed system in the coloring agent particle dispersion was maintained. The acid value of the toner was 61 mg-KOH.

The toner was subjected to measurement of dynamic viscoelasticity, and it was found that the relaxation modulus of elasticity G(t) at a fixing time of 270 msec and a fixing temperature of 150° C. was $1.8\times10^2$ Pa, the relaxation modulus of elasticity G(t=0.01) at a relaxation time of 0.01 sec was $5.3\times10^4$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 25.5.

The charge property of the toner was measured, and the toner exhibited −41 μC/g under a condition of 23° C. and 60% RH, −53 μC/g under a condition of 10° C. and 30% RH, and −18 μC/g under a condition of 28° C. and 85% RH.

Comparative Example 3

A toner was obtained in the same manner as in Example 1 except that in Preparation of Coloring Agent Particle Dispersion 1, the additional amount of the resin fine particle dispersion was changed from 60 parts by weight to 0.2 part by weight, and the pH at the completion of aggregation was changed to 3.6.

The volume average particle diameter $D_{50}$ of the toner measured by a Coulter Counter was 9.2 μm, and the volume average particle diameter distribution coefficient GSDv was 1.27. The ratio (GSDv/GSDp) of the volume average particle diameter distribution coefficient GSDv to the number average particle diameter distribution coefficient GSDp was 1.34.

The toner was subjected to shape observation by using a LUZEX image analyzing device, and it was observed that the shape factor SF1 of the particle was 108, i.e., a spherical shape. From the observation of the cross sectional image of the toner with a scanning electron microscope (SEM), the releasing agent particles were partially aggregated in the toner particles and had an arithmetic average mean particle diameter of 2,730 nm. The mean particle diameter of the coloring agent particle was 370 nm. The acid value of the toner was 16 mg-KOH.

The toner was subjected to measurement of dynamic viscoelasticity, and it was found that the relaxation modulus of elasticity G(t) at a fixing time of 40 msec and a fixing temperature of 160° C. was $3.4\times10^3$ Pa, the relaxation modulus of elasticity G(t=0.01) at a relaxation time of 0.01 sec was $8.1\times10^4$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 0.9.

The charge property of the toner was measured, and the toner exhibited −30 μC/g under a condition of 23° C. and 60% RH, −62 μC/g under a condition of 10° C. and 30% RH, and −26 μC/g under a condition of 28° C. and 85% RH.

Comparative Example 4

A toner was obtained in the same manner as in Example 1 except that the addition amount of the releasing agent dispersion was changed from 50 parts by weight to 27 parts by weight, and the pH at the completion of aggregation was changed from 6.5 to 7.2.

The volume average particle diameter $D_{50}$ of the toner measured by a Coulter Counter was 7.3 μm, and the volume average particle diameter distribution coefficient GSDv was 1.31. The ratio (GSDv/GSDp) of the volume average particle diameter distribution coefficient GSDv to the number average particle diameter distribution coefficient GSDp was 1.25.

The toner was subjected to shape observation by using a LUZEX image analyzing device, and it was observed that the shape factor SF1 of the particle was 145, i.e., an irregular shape. From the observation of the cross sectional image of the toner with a scanning electron microscope (SEM), the releasing agent particles were partially aggregated in the toner particles and had an arithmetic average mean particle diameter of 1,660 nm. The mean particle diameter of the coloring agent particle was 390 nm. Accordingly, the dispersed system in the coloring agent particle dispersion was maintained. The acid value of the toner was 19 mg-KOH.

The toner was subjected to measurement of dynamic viscoelasticity, and it was found that the relaxation modulus of elasticity G(t) at a fixing time of 100 msec and a fixing temperature of 160° C. was $3.1\times10^2$ Pa, the relaxation modulus of elasticity G(t=0.01) at a relaxation time of 0.01 sec was $9.3\times10^4$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 30.0. That is, the coloring agent particles and the releasing agent particles formed the structure in the toner.

The charge property of the toner was measured, and the toner exhibited low charge property of −17 μC/g under a condition of 23° C. and 60% RH, −21 μC/g under a condition of 10° C. and 30% RH, and −14 μC/g under a condition of 28° C. and 85% RH.

Comparative Example 5

A toner was obtained in the same manner as in Example 1 except that the addition amount of the releasing agent dispersion was changed from 50 parts by weight to 3.5 parts by weight, the aggregation conditions were changed from 51° C. for 60 minutes to 41° C. for 30 minutes, and the temperature for fusing and uniting was changed from 97° C. to 83° C.

The volume average particle diameter $D_{50}$ of the toner measured by a Coulter Counter was 2.7 μm, and the volume average particle diameter distribution coefficient GSDv was 1.34. The ratio (GSDv/GSDp) of the volume average particle diameter distribution coefficient GSDv to the number average particle diameter distribution coefficient GSDp was 1.37.

The toner was subjected to shape observation by using a LUZEX image analyzing device, and it was observed that the shape factor SF1 of the particle was 144, i.e., an irregular shape. From the observation of the cross sectional image of the toner with a scanning electron microscope (SEM), the releasing agent particles were dispersed in the toner particles and had an arithmetic average mean particle diameter of 100 nm, and the mean particle diameter of the coloring agent particle was 178 nm. The acid value of the toner was 15.5 mg-KOH.

The toner was subjected to measurement of dynamic viscoelasticity, and it was found that the relaxation modulus of elasticity G(t) at a fixing time of 30 msec and a fixing temperature of 150° C. was $5.1\times10^3$ Pa, the relaxation modulus of elasticity G(t=0.01) at a relaxation time of 0.01 sec was $7.2\times10^4$ Pa, and the ratio G(r) of the relaxation modulus of elasticity G(t=0.01) at a relaxation time of 0.01 sec to a relaxation modulus of elasticity G(t=0.1) at a relaxation time of 0.1 sec was 19.2.

The charge property of the toner was measured, and the toner exhibited low charge property of −17 μC/g under a condition of 23° C. and 60% RH, −20 μC/g under a condition of 10° C. and 30% RH, and −11 μC/g under a condition of 28° C. and 85% RH.

(Preparation of Developer)

To 50 g of the toners obtained in Examples 1 to 14 and Comparative Examples 1 to 5, 0.5% by weight of hydrophobic silica (TS720 produced by Cabot, Inc.), and mixed in a sample mill to obtain an externally added toner. Separately, a ferrite carrier having an average particle diameter of 50 μm coated with 1% by weight of polymethacrylate (produced by Soken Kagaku Co., Ltd.) was prepared and weighed in such a manner that the concentration of the externally added became 5%, followed by stirring and mixing in a ball mill for 5 minutes, to obtain developers of Examples 1 to 14 and Comparative Examples 1 to 5.

(Evaluation)

(1) Measurement of Peeling Strength

The measurement of the peeling strength was conducted in such a manner that the fixing was conducted by an oil-less fixing method to JIS S-paper as a receiving material, using a modified fixing apparatus, A-Color 935 (produced by Fuji Xerox Co., Ltd.), and then a peeling test was conducted in the following manner.

Preparation of Fixing Apparatus (a) A metallic peeling tooth (shown in FIG. 1) having the same shape as one used in A-Color 935 (produced by Fuji Xerox Co., Ltd.) was produced. A cut part was formed on the slanted area of the peeling tooth, and a strain gauge (KFG-1-120-C1-16 produced by Kyowa Dengyo Co., Ltd.) was adhered thereto.

(b) The relationship between a load applied to the peeling tooth and the strain of the tooth was obtained by using a weight, and a calibration curve was prepared.

Figure 2:
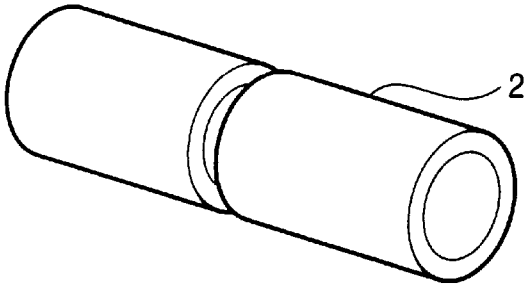
FIG. 2 is a perspective view of a heating roll used in the measurement of peeling strength in the invention.

(c) A groove having a width of 4 mm and a depth of 1 mm was formed on the central part of the heating roll along the periphery of the roll as shown in FIG. 2.

Figure 3:
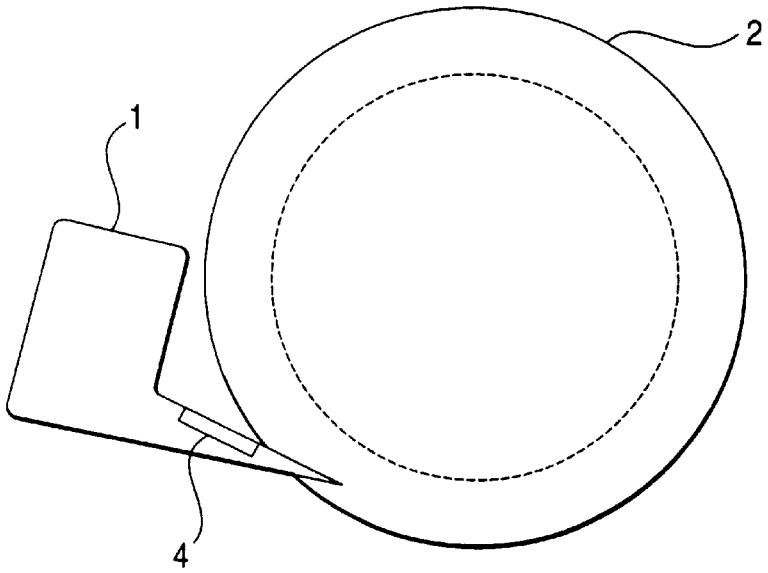
FIG. 3 is a cross sectional view showing the relationship between the heating roll and the peeling tooth on the measurement of the peeling strength in the invention.

(d) The heating roll thus modified was set in the modified fixing apparatus, A-Color 935 (produced by Fuji Xerox Co., Ltd.), and the peeling tooth was fixed in the main body of the fixing apparatus in such a manner that the tip end of the tooth was inserted in the groove but was not in contact with the main body of the heating roll (as shown in FIG. 3).

Measurement of the Peeling Strength

An image that had not been fixed was inserted in the modified fixing apparatus, A-Color 935 (produced by Fuji Xerox Co., Ltd.) having been configured in item (d) above. The strain of the peeling tooth was measured by a dynamic strain measurement device (DMP-711B produced by Kyowa Dengyo Co., Ltd.) connected to the strain gauge, and the peeling strength was obtained from the calibration curve prepared in item (b) above. The evaluation standard of the peeling strength F was as follows:

F≦20 gf: A material to be fixed was peeled from the fixing roll without any problem.

20 gf<F≦35 gf: Peeling could be conducted but defects such as unevenness of the image occurred.

35 gf<F≦50 gf: Peeling became unstable, and rolling up on the fixing roll partly occurred.

50 gf<F: A material to be fixed could not be peeled and entirely rolled up on the fixing roll.

(2) Measurement of Offset Temperature

It was measured by using the modified fixing apparatus, A-Color 935 (produced by Fuji Xerox Co., Ltd.). The temperature of the fixing roll was increased stepwise from 150° C. to 200° C. by 5° C., and the generation of offset was confirmed by the naked eyes, so that the offset temperature was determined by the temperature at which offset was observed.

(3) Bending Resistance of Fixed Image

A fixed image was prepared by using the modified fixing apparatus, A-Color 935 (produced by Fuji Xerox Co., Ltd.). A bending stress was applied to the fixed image, and the degree of damage on the image was evaluated by the naked eyes. The evaluation standard was as follows:

G1: No damage was formed on the fixed image.

G2: A very light damage was observed at fold line, but it did not cause any practical problem.

G3: A damage that could be clearly confirmed by the naked eyes was formed on the image.

G4: Considerable image defects were formed as centering the fold line.

(4) Image Quality Test

The developers of Examples 1 to 14 and Comparative Examples 1 to 5, high quality paper for A-Color and an OHP sheet for A-Color were applied to the modified fixing apparatus, A-Color 935 (produced by Fuji Xerox Co., Ltd.), to form a fixed image, and visibility of the image, scattering of the toner, fogging and surface gloss were evaluated. A fixed image was also formed using an OHP sheet as the receiving material, and transparency on an OHP sheet was evaluated.

The results of the evaluation are shown in Tables 1 to 4. In the evaluation of visibility of the image, scattering of the toner, fogging, transparency on an OHP sheet, dispersibility of the releasing agent, dispersibility of the coloring agent and surface gloss, symbol O denotes good, and denotes poor.

TABLE 1

| | Example 1 | Example 2 | Example 3 | Example 4 | Example 5 |
|---|---|---|---|---|---|
| Fixing time (msec) | 100 | 40 | 240 | 15 | 230 |
| Fixing temperature (° C.) | 160 | 150 | 160 | 160 | 160 |
| Relaxation modulus of elasticity (Pa) | $2.9 \times 10^2$ | $8.1 \times 10^3$ | $2.8 \times 10^3$ | $2.4 \times 10^3$ | $4.8 \times 10^3$ |
| Relaxation modulus of elasticity G (t = 0.01) | $5.1 \times 10^3$ | $7.2 \times 10^3$ | $5.8 \times 10^3$ | $7.3 \times 10^3$ | $1.1 \times 10^4$ |
| G (t = 0.01)/G (t = 0.1) | 17.8 | 3.6 | 3.2 | 13.0 | 5.5 |
| Acid value of toner (mg-KOH) | 18 | 19 | 18 | 49.9 | 38 |
| Releasing agent | | | | | |
| Mean particle diameter (nm) | 200 | 360 | 180 | 240 | 240 |
| Content (% by weight) | 10 | 5 | 10 | 10 | 25 |
| Coloring agent | | | | | |
| Mean particle diameter (nm) | 176 | 194 | 175 | 160 | 160 |
| Content (% by weight) | 6 | 10 | 6 | 6 | 15 |
| Toner | | | | | |
| $D_{50v}$ | 6.2 | 6.0 | 5.7 | 5.7 | 5.7 |
| GSDv | 1.20 | 1.22 | 1.19 | 1.19 | 1.20 |
| GSDv/GSDp | 1.10 | 1.01 | 0.99 | 1.03 | 1.00 |
| SF1 of toner | 130 | 112 | 140 | 131 | 131 |
| Charge amount of toner | | | | | |
| 23° C., 68% RH | −27 | −29 | −28 | −30 | −32 |
| 10° C., 30% HR | −29 | −30 | −32 | −31 | −36 |
| 28° C., 85% RH | −24 | −25 | −27 | −28 | −28 |
| Peeling Strength F | 19 | 18 | 20 | 16 | 15 |
| Offset temperature (° C.) | >200 | >200 | >200 | >200 | >200 |
| Bending resistance | G1 | G1 | G1 | G1 | G1 |
| Visibility of image | ○ | ○ | ○ | ○ | ○ |
| Scattering of toner | ○ | ○ | ○ | ○ | ○ |
| Fogging | ○ | ○ | ○ | ○ | ○ |
| Transparency on OHP sheet | ○ | ○ | ○ | ○ | ○ |
| Dispersibility of releasing agent | ○ | ○ | ○ | ○ | ○ |
| Dispersibility of coloring agent | ○ | ○ | ○ | ○ | ○ |
| Surface gloss | ○ | ○ | ○ | ○ | ○ |

TABLE 2

| | Example 6 | Example 7 | Example 8 | Example 9 | Example 10 |
|---|---|---|---|---|---|
| Fixing time (msec) | 28 | 31 | 60 | 40 | 48 |
| Fixing temperature (° C.) | 150 | 150 | 150 | 150 | 160 |
| Relaxation modulus of elasticity (Pa) | $4.3 \times 10^2$ | $6.1 \times 10^2$ | $8.0 \times 10^2$ | $9.2 \times 10^2$ | $7.8 \times 10^2$ |
| Relaxation modulus of elasticity G (t = 0.01) | $2.2 \times 10^2$ | $9.8 \times 10^3$ | $3.6 \times 10^3$ | $2.1 \times 10^4$ | $6.3 \times 10^3$ |
| G (t = 0.01)/G (t = 0.1) | 6.0 | 5.0 | 4.3 | 1.1 | 3.2 |
| Acid value of toner (mg-KOH) | 19 | 19 | 22 | 17 | 14 |
| Releasing agent | | | | | |
| Mean particle diameter (nm) | 260 | 255 | 260 | 180 | 270 |
| Content (% by weight) | 10 | 10 | 10 | 10 | 10 |
| Coloring agent | | | | | |
| Mean particle diameter (nm) | 172 | 196 | 121 | 115 | 183 |
| Content (% by weight) | 4.5 | 6.5 | 5 | 6 | 6 |
| Toner | | | | | |
| $D_{50v}$ | 5.9 | 6.1 | 6.5 | 4.1 | 5.8 |
| GSDv | 1.18 | 1.22 | 1.24 | 1.23 | 1.23 |
| GSDv/GSDp | 1.00 | 0.94 | 0.94 | 1.29 | 0.96 |
| SF1 of toner | 134 | 130 | 131 | 129 | 130 |
| Charge amount of toner | | | | | |
| 23° C., 68% RH | −28 | −29 | −25 | −25 | −28 |
| 10° C., 30% HR | −30 | −33 | −25 | −25 | −30 |
| 28° C., 85% RH | −25 | −27 | −22 | −22 | −25 |
| Peeling Strength F | 16 | 18 | 15 | 18 | 10 |
| Offset temperature (° C.) | >200 | >200 | >200 | >200 | >200 |
| Bending resistance | G1 | G1 | G1 | G1 | G1 |
| Visibility of image | o | ○ | ○ | ○ | ○ |
| Scattering of toner | o | ○ | ○ | ○ | ○ |
| Fogging | o | ○ | ○ | ○ | ○ |
| Transparency on OHP sheet | o | ○ | ○ | ○ | ○ |
| Dispersibility of releasing agent | o | ○ | ○ | ○ | ○ |
| Dispersibility of coloring agent | o | ○ | ○ | ○ | ○ |
| Surface gloss | o | ○ | ○ | ○ | ○ |

TABLE 3

| | Example 11 | Example 12 | Example 13 | Example 14 |
|---|---|---|---|---|
| Fixing time (msec) | 35 | 26 | 45 | 60 |
| Fixing temperature (° C.) | 150 | 160 | 150 | 160 |
| Relaxation modulus of elasticity (Pa) | $7.2 \times 10^2$ | $2.0 \times 10^2$ | $1.7 \times 10^3$ | $9.6 \times 10^2$ |
| Relaxation modulus of elasticity G (t = 0.01) | $5.1 \times 10^3$ | $2.4 \times 10^3$ | $9.6 \times 10^3$ | $6.8 \times 10^3$ |
| G (t = 0.01)/G (t = 0.1) | 1.3 | 1.1 | 10.1 | 3.4 |
| Acid value of toner (mg-KOH) | 17 | 16 | 21 | 12 |
| Releasing agent | | | | |
| Mean particle diameter (nm) | 730 | 730 | 360 | 240 |
| Content (% by weight) | 10 | 10 | 5.2 | 10 |
| Coloring agent | | | | |
| Mean particte diameter (nm) | 188 | 188 | 197 | 173 |
| Content (% by weight) | 6.5 | 6 | 6.5 | 6.5 |
| Toner | | | | |
| $D_{50v}$ | 7.2 | 6.2 | 9.0 | 6.1 |
| GSDv | 1.22 | 1.21 | 1.24 | 1.21 |
| GSDv/GSDp | 1.14 | 0.98 | 0.86 | 1.11 |
| SF1 of toner | 118 | 134 | 137 | 129 |
| Charge amount of toner | | | | |
| 23° C., 68% RH | −27 | −26 | −26 | −27 |
| 10° C., 30% HR | −29 | −29 | −28 | −28 |
| 28° C., 85% RH | −23 | −24 | −25 | −27 |
| Peeling Strength F | 8 | 7 | 12 | 22 |
| Offset temperature (° C.) | >200 | >200 | >200 | >200 |
| Bending resistance | G2 | G2 | G2 | G1 |
| Visibility of image | ○ | ○ | ○ | ○ |
| Scattering of toner | ○ | ○ | ○ | ○ |

TABLE 3-continued

| | Example 11 | Example 12 | Example 13 | Example 14 |
|---|---|---|---|---|
| Fogging | ○ | ○ | ○ | ○ |
| Transparency on OHP sheet | ○ | ○ | ○ | ○ |
| Dispersibility of releasing agent | ○ | ○ | ○ | ○ |
| Dispersibility of coloring agent | ○ | ○ | ○ | ○ |
| Surface gloss | ○ | ○ | ○ | ○ |

TABLE 4

| | Comparative Example 1 | Comparative Example 2 | Comparative Example 3 | Comparative Example 4 | Comparative Example 5 |
|---|---|---|---|---|---|
| Fixing time (msec) | 60 | 270 | 40 | 100 | 30 |
| Fixing temperature (° C.) | 160 | 150 | 160 | 160 | 150 |
| Relaxation modulus of elasticity (Pa) | $4.8 \times 10^3$ | $1.8 \times 10^2$ | $3.4 \times 10^3$ | $3.1 \times 10^2$ | $5.1 \times 10^3$ |
| Relaxation modulus of elasticity G (t = 0.01) | $4.2 \times 10^2$ | $5.3 \times 10^4$ | $8.1 \times 10^4$ | $9.3 \times 10^4$ | $7.2 \times 10^4$ |
| G (t = 0.01)/G (t = 0.1) | 0.8 | 25.5 | 0.9 | 30.0 | 19.2 |
| Acid value of toner (mg-KOH) | 9.8 | 61 | 16 | 19 | 15.5 |
| Releasing agent | | | | | |
| Mean particle diameter (nm) | 1,390 | 270 | 2,730 | 1,660 | 100 |
| Content (% by weight) | 10 | 10 | 10 | 3.0 | 5.0 |
| Coloring agent | | | | | |
| Mean particle diameter (nm) | 270 | 191 | 370 | 390 | 178 |
| Content (% by weight) | 6.5 | 6.5 | 6.5 | 6.5 | 6.0 |
| Toner | | | | | |
| $D_{50v}$ | 6.8 | 8.1 | 9.2 | 7.3 | 2.7 |
| GSDv | 1.22 | 1.25 | 1.27 | 1.31 | 1.34 |
| GSDv/GSDp | 1.01 | 1.27 | 1.34 | 1.25 | 1.37 |
| SF1 of toner | 133 | 140 | 108 | 145 | 144 |
| Charge amount of toner | | | | | |
| 23° C., 68% RH | −24 | −41 | −30 | −17 | −17 |
| 10° C., 30% HR | −39 | −53 | −62 | −21 | −20 |
| 28° C., 85% RH | −26 | −18 | −26 | −14 | −11 |
| Peeling Strength F | 29 | 63 | 42 | 26 | 156 |
| Offset temperature (° C.) | 180 | 180 | 180 | 175 | 160 |
| Bending resistance | G3 | G1 | G3 | G4 | G1 |
| Visibility of image | ○ | X*2) | X*3) | X*4) | X*5) |
| Scattering of toner | ○ | ○ | ○ | X*4) | X |
| Fogging | ○*1) | ○ | ○ | X*4) | X |
| Transparency on OHP sheet | low transmitted light amount | slightly blackish image | slightly blackish image | slightly blackish | blackish |
| Dispersibility of releasing agent | X | X | X | X | X |
| Dispersibility of coloring agent | X | X | X | X | X |
| Surface gloss | ○ | ○ | X | X | X |

Note:
*1)Fogging occurred at a high temperature and a high humidity.
*2)The image density was lowered, and fogging occurred at a high temperature and a high humidity.
*3)the image density was lowered at a low temperature and a low humidity.
*4)The image was unclear, and scattering of the toner and fogging occurred at a high temperature and high humidity.
*5)the image density was lowered.

(Result)

It was clear from Tables 1 to 4 that when a fixed image was formed by using the toners of Examples 1 to 14, the image obtained was clear, and any defect, such as scattering of the toner and fogging, was not observed. The fixing property of the toners was evaluated by using the modified fixing apparatus, A-Color 935 (produced by Fuji Xerox Co., Ltd.), the peelability by a perfluoroalkoxy ether (PFA) tube roller and the gloss were good in all Examples, in which the fixing sheet could be peeled from the fixing roller without any resistance. The surface gloss of the fixing sheet was also good. When the toners of Examples 1 to 8 were applied to an OHP sheet to form a fixed image in the same manner as above, the transparency on an OHP sheet was good, and a transparent image without fogging could be obtained.

When the toner of Comparative Example 1 was applied in the same manner as above, the encompassment of the coloring agent was insufficient, and adverse affects were observed in charge property under high temperature and high humidity conditions. An offset phenomenon and peeling defective at a low temperature side occurred. Furthermore, when the toner of Comparative Example 1 was applied to an OHP sheet, it was observed that the transmission light amount was decreased due to internal light scattering, and the minuteness of the projected image was slightly deteriorated.

When the toner of Comparative Example 2 was applied in the same manner as above, the charge amount under ordinary conditions and low temperature and low humidity conditions was high, and the image density was low. Under high temperature and high humidity conditions, decrease in charge amount was observed, and fogging occurred. Furthermore, with respect to the peelability, an offset phenomenon and peeling defective at a low temperature side occurred. When the toner of Comparative Example 2 was applied to an OHP sheet, it was observed that the image on the OHP sheet was slightly blackish.

When the toner of Comparative Example 3 was applied in the same manner as above, the charge amount under ordinary conditions and low temperature and low humidity conditions was high, and the image density was low. The surface gloss was uneven. With respect to the peelability, an offset phenomenon and peeling defective at a low temperature side occurred. When the toner of Comparative Example 3 was applied to an OHP sheet, it was observed that the image on the OHP sheet was blackish.

When the toner of Comparative Example 4 was applied in the same manner as above, the charge amount was low and fogging and scattering of the toner occurred under all conditions, and a clear image was not obtained. While the peelability was good, the bending resistance of the fixed image was considerably deteriorated. While the surface gloss was uniform, an offset phenomenon and peeling defective at a low temperature side occurred. When the toner of Comparative Example 4 was applied to an OHP sheet, it was observed that the image on the OHP sheet was slightly blackish.

When the toner of Comparative Example 5 was applied in the same manner as above, fogging and scattering of the toner occurred under all conditions, and a clear image was not obtained. Rolling up on the roller occurred in the peelability test. The surface gloss of the fixed image was uneven. Furthermore, when the toner of Comparative Example 5 was applied to an OHP sheet, it was observed that the image on the OHP sheet was blackish.

According to the invention having the constitution described above, a high quality fixed image can be provided that is excellent in peelability of the fixing sheet, adhesion of the fixed image, bending resistance of the fixed image, Dispersibility of the releasing agent in the toner, Dispersibility of the coloring agent in the toner and transparency on an OHP sheet.

What is claimed is:

1. A toner for developing electrostatic charge comprising a coloring agent and a binder resin, said toner having a relaxation modulus of elasticity G(t) at a relaxation time t=10×Dt (wherein Dt represents a heating time on fixing) obtained from measurement of dynamic viscoelasticity in a range of from $2.0\times10^2$ to $3.0\times10^3$ Pa.

2. A toner for developing electrostatic charge comprising a coloring agent and a binder resin, said toner having a relaxation modulus of elasticity G(t=0.01) at a relaxation time of 0.01 sec obtained from measurement of dynamic viscoelasticity in a range of from $2.0\times10^2$ to $3.0\times10^4$ Pa, and a ratio G(r) (G(t=0.01)/G(t=0.1)) of the relaxation modulus of elasticity G(t=0.01) to a relaxation modulus of elasticity G(t=0.1) at a relaxation time of 0.1 sec in a range of from 1.0 to 18.0.

3. A toner for developing electrostatic charge as claimed in claim 1, wherein said toner for developing electrostatic charge further comprises a releasing agent.

4. A toner for developing electrostatic charge as claimed in claim 2, wherein said toner for developing electrostatic charge further comprises a releasing agent.

5. A toner for developing electrostatic charge as claimed in claim 1, wherein said toner for developing electrostatic charge has an acid value of from 10 to 50 mg-KOH.

6. A toner for developing electrostatic charge as claimed in claim 2, wherein said toner for developing electrostatic charge has an acid value of from 10 to 50 mg-KOH.

7. A toner for developing electrostatic charge as claimed in claim 3, wherein said releasing agent has a main maximum peak measured according to ASTEM D3418-8 in a range of from 50 to 140° C.

8. A toner for developing electrostatic charge as claimed in claim 3, wherein said toner for developing electrostatic charge further comprises a releasing agent having an average particle diameter measured by a transmission electron microscope (TEM) in a range of from 150 to 1,500 nm.

9. A toner for developing electrostatic charge as claimed in claim 3, wherein said toner for developing electrostatic charge further comprises said releasing agent in an amount of from 5 to 25 parts by weight.

10. A toner for developing electrostatic charge as claimed in claim 1, wherein said toner for developing electrostatic charge has a volume average particle diameter $D_{50v}$ in a range of from 2 to 9 $\mu$m, a volume average particle diameter distribution coefficient GSDv ($D_{84v}/D_{16v}$) of 1.30 or less, and a ratio (GSDv/GSDp) of said volume average particle diameter distribution coefficient GSDv to a number average particle diameter distribution coefficient GSDp ($D_{84p}/D_{16p}$) of 0.95 or more.

11. A toner for developing electrostatic charge as claimed in claim 1, wherein said toner for developing electrostatic charge has a shape factor SF1 (an average value of (circumference length squared/projected area)) in a range of from 110 to 140.

12. A toner for developing electrostatic charge as claimed in claim 1, wherein said toner for developing electrostatic charge has an absolute value of a charge amount in a range of from 20 to 40 $\mu$C/g.

13. A process for producing a toner for developing electrostatic charge as claimed in claim 1, said process comprising the steps of: mixing a resin fine particle dispersion having resin fine particles having a diameter of 1 $\mu$m or less dispersed therein and a coloring agent particle dispersion to form an aggregated particle dispersion of said resin fine particles, said coloring agent particles and releasing agent particles; and then heating to a temperature higher than a glass transition point of said resin fine particles to fuse and unite said particles.

14. A developer for developing electrostatic charge comprising a carrier and a toner, said toner is a toner for developing electrostatic charge as claimed in claim 1.

15. A process for forming an image comprising a step of forming an electrostatic latent image on an electrostatic image supporting material; a step of forming a toner image by developing said electrostatic latent image with a developer on a developer supporting material; and a step of transferring said toner image to a receiving material, wherein said developer is a developer for developing electrostatic charge as claimed in claim 14.

16. A process for forming an image as claimed in claim 15, wherein said toner image is fixed by an oil-less fixing method.

17. A process for forming an image as claimed in claim 16, wherein said toner image on the receiving material is fixed by a fixing roll having a surface layer comprising a fluorine resin.

18. A process for forming an image as claimed in claim 15, wherein said process further comprises a step of recovering a toner for developing electrostatic charge remaining unused for forming the toner image; and a step of recycling said toner for developing electrostatic charge recovered in said recovering step into a developing apparatus.

* * * * *